US008789734B2

(12) United States Patent
Cross et al.

(10) Patent No.: US 8,789,734 B2
(45) Date of Patent: Jul. 29, 2014

(54) CARRY BAGS WITH TENSILE STRAND REINFORCING ELEMENTS

(75) Inventors: Tory M. Cross, Portland, OR (US); Christopher M. Helmsworth, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 355 days.

(21) Appl. No.: 12/467,446

(22) Filed: May 18, 2009

(65) Prior Publication Data

US 2010/0288812 A1 Nov. 18, 2010

(51) Int. Cl.

| | |
|---|---|
| ***A45F 3/00*** | (2006.01) |
| ***A45F 3/04*** | (2006.01) |
| ***A45C 13/30*** | (2006.01) |
| ***A45F 3/02*** | (2006.01) |
| ***A63B 55/00*** | (2006.01) |
| ***A45F 3/14*** | (2006.01) |

(52) U.S. Cl.

USPC ..... 224/628; 224/600; 224/601; 224/602; 224/627; 224/635; 224/639; 224/257; 224/259; 2/248; 2/261

(58) Field of Classification Search

USPC ..... 224/600, 601, 602, 627, 635, 639, 257, 224/259; 2/248, 261

See application file for complete search history.

(56) References Cited

U.S. PATENT DOCUMENTS

| | | | | |
|---|---|---|---|---|
| 2,205,356 A | | 6/1940 | Gruensfelder | |
| 3,425,737 A | * | 2/1969 | Sutton | 294/74 |
| 3,439,434 A | | 4/1969 | Tangorra | |
| 3,672,078 A | | 6/1972 | Fukuoka | |
| 3,823,493 A | | 7/1974 | Brehm et al. | |
| 3,862,877 A | * | 1/1975 | Camden | 428/111 |
| 4,116,481 A | * | 9/1978 | Raue | 294/74 |
| 4,261,493 A | * | 4/1981 | Newman | 224/257 |
| 4,693,167 A | * | 9/1987 | Bagwell, Jr. | 89/35.01 |
| 4,756,098 A | | 7/1988 | Boggia | |
| 4,856,837 A | * | 8/1989 | Hammersla, Jr. | 294/74 |
| 4,858,339 A | | 8/1989 | Hayafuchi et al. | |
| 4,858,797 A | * | 8/1989 | Rabska | 224/162 |
| 4,873,725 A | | 10/1989 | Mitchell | |

(Continued)

FOREIGN PATENT DOCUMENTS

| | | |
|---|---|---|
| DE | 29911710 | 12/1999 |
| DE | 20215559 | 1/2003 |

(Continued)

OTHER PUBLICATIONS

International Search Report and Written Opinion mailed Jan. 14, 2011 in International Application No. PCT/US2010/034779.

(Continued)

*Primary Examiner* — Brian D Nash
*Assistant Examiner* — Derek Battisti
(74) *Attorney, Agent, or Firm* — Plumsea Law Group, LLC

(57) ABSTRACT

A carry bag may include a container portion and a strap portion. The container portion defines an interior compartment for containing objects, and the strap portion extends from the container portion. At least one of the container portion and the strap portion include (a) a base element formed from a two-dimensional material and (b) a strand formed from a one-dimensional material. The strand lies adjacent to and substantially parallel to a surface of the base element for a distance of at least five centimeters.

30 Claims, 23 Drawing Sheets

(56) References Cited

U.S. PATENT DOCUMENTS

| | | | | | |
|---|---|---|---|---|---|
| 4,879,768 | A | * | 11/1989 | McClees et al. | 224/264 |
| 4,936,495 | A | * | 6/1990 | Van de Pol | 224/627 |
| 5,156,022 | A | | 10/1992 | Altman | |
| 5,255,833 | A | | 10/1993 | McAllister | |
| 5,271,130 | A | | 12/1993 | Batra | |
| 5,285,658 | A | | 2/1994 | Altman et al. | |
| 5,345,638 | A | | 9/1994 | Nishida | |
| 5,359,790 | A | | 11/1994 | Iverson et al. | |
| 5,367,795 | A | | 11/1994 | Iverson et al. | |
| 5,511,846 | A | * | 4/1996 | Fuller | 294/149 |
| 5,579,966 | A | * | 12/1996 | Krumweide et al. | 224/637 |
| 5,584,422 | A | * | 12/1996 | Bond-Madsen | 224/155 |
| 5,832,540 | A | | 11/1998 | Knight | |
| D405,587 | S | | 2/1999 | Merikoski | |
| 5,990,378 | A | | 11/1999 | Ellis | |
| 6,003,247 | A | | 12/1999 | Steffe | |
| 6,004,891 | A | | 12/1999 | Tuppin et al. | |
| 6,029,376 | A | | 2/2000 | Cass | |
| 6,038,702 | A | | 3/2000 | Knerr | |
| 6,170,175 | B1 | | 1/2001 | Funk | |
| 6,213,634 | B1 | | 4/2001 | Harrington et al. | |
| 6,615,427 | B1 | | 9/2003 | Hailey | |
| 6,910,288 | B2 | | 6/2005 | Dua | |
| 7,337,560 | B2 | | 3/2008 | Marvin et al. | |
| 2003/0178738 | A1 | | 9/2003 | Staub et al. | |
| 2004/0074589 | A1 | | 4/2004 | Gessler et al. | |
| 2004/0142631 | A1 | | 7/2004 | Luk | |
| 2004/0261295 | A1 | | 12/2004 | Meschter | |
| 2005/0115284 | A1 | | 6/2005 | Dua | |
| 2005/0268497 | A1 | | 12/2005 | Alfaro | |
| 2006/0048413 | A1 | | 3/2006 | Sokolowski et al. | |
| 2007/0199210 | A1 | | 8/2007 | Vattes et al. | |
| 2008/0110049 | A1 | | 5/2008 | Sokolowski et al. | |
| 2008/0156835 | A1 | * | 7/2008 | Schlipper | 224/264 |

FOREIGN PATENT DOCUMENTS

| | | | |
|---|---|---|---|
| EP | 0082824 | | 6/1983 |
| EP | 0818289 | A2 | 1/1998 |
| FR | 1462349 | A | 2/1967 |
| FR | 2457651 | A1 | 12/1980 |
| JP | 2003310331 | | 11/2003 |
| WO | 98/43506 | A | 10/1998 |
| WO | 9843506 | | 10/1998 |
| WO | 03/013301 | A1 | 2/2003 |

OTHER PUBLICATIONS

Communication pursuant to Article 94(3) EPC for European Patent Application No. EP 10731622.6, mailed on Oct. 17, 2012.

* cited by examiner

CARRY BAGS WITH TENSILE STRAND REINFORCING ELEMENTS

BACKGROUND

Carry bags are frequently utilized by an individual to transport a variety of personal belongings or other items. Various examples of carry bags include backpacks, duffel bags, handbags (e.g., purses, totes, satchels), messenger bags, brief cases, and luggage. In general, a carry bag includes a container portion and at least one strap portion. The container portion is often hollow to define an interior compartment for receiving the personal belongings or other items. The strap portion extends outward from the container portion and provides a structure for holding or otherwise carrying the carry bag.

SUMMARY

A carry bag may include a container portion and a strap portion. The container portion defines an interior compartment for containing objects, and the strap portion extends from the container portion. At least one of the container portion and the strap portion include (a) a base element formed from a two-dimensional material and (b) a strand formed from a one-dimensional material. The strand lies adjacent to and substantially parallel to a surface of the base element for a distance of at least five centimeters.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

Figure 1:
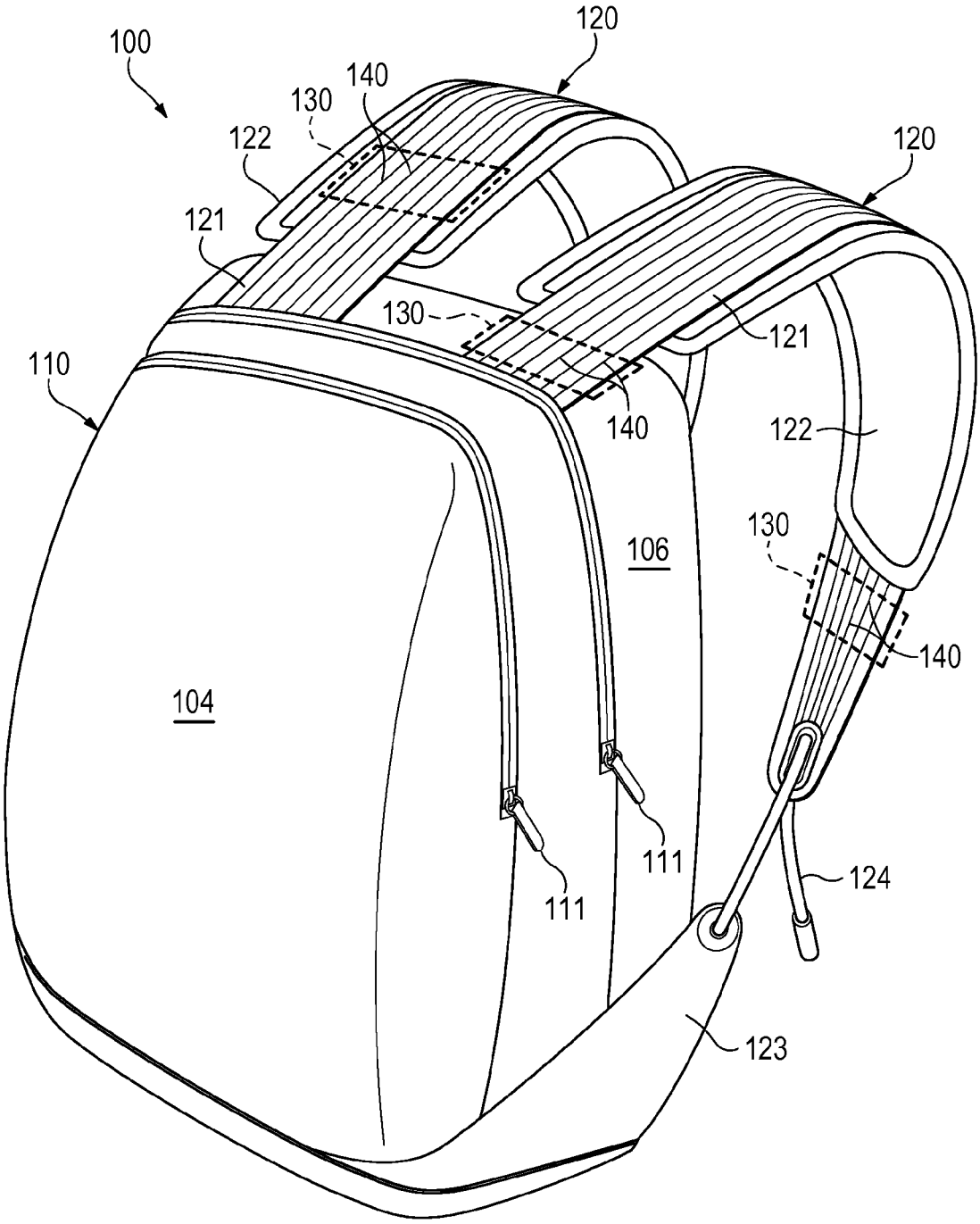
FIG. 1 is a perspective view of a first carry bag having a design of a backpack.
Figure 2:
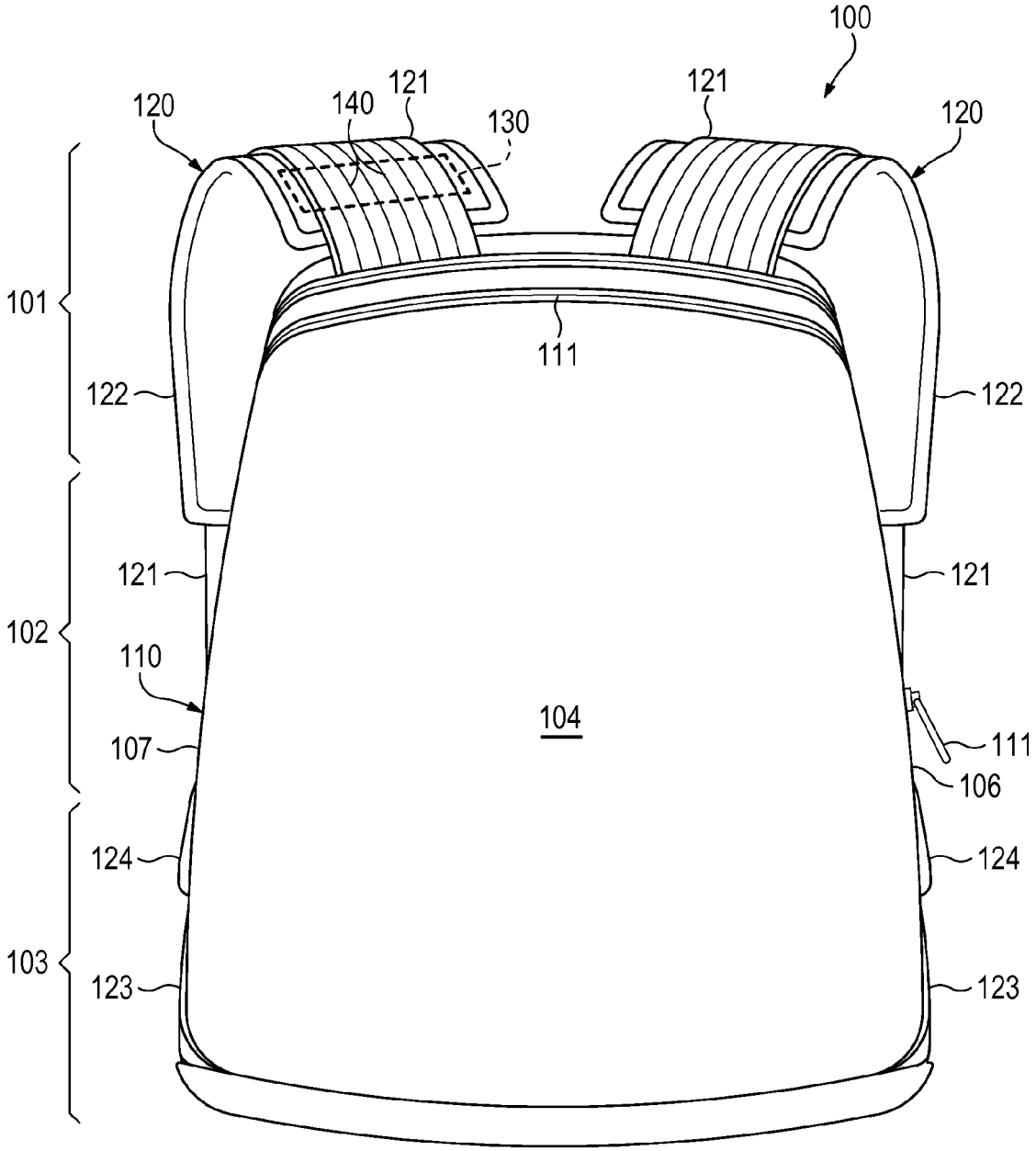
FIG. 2 is a front elevational view of the first carry bag.
Figure 3:
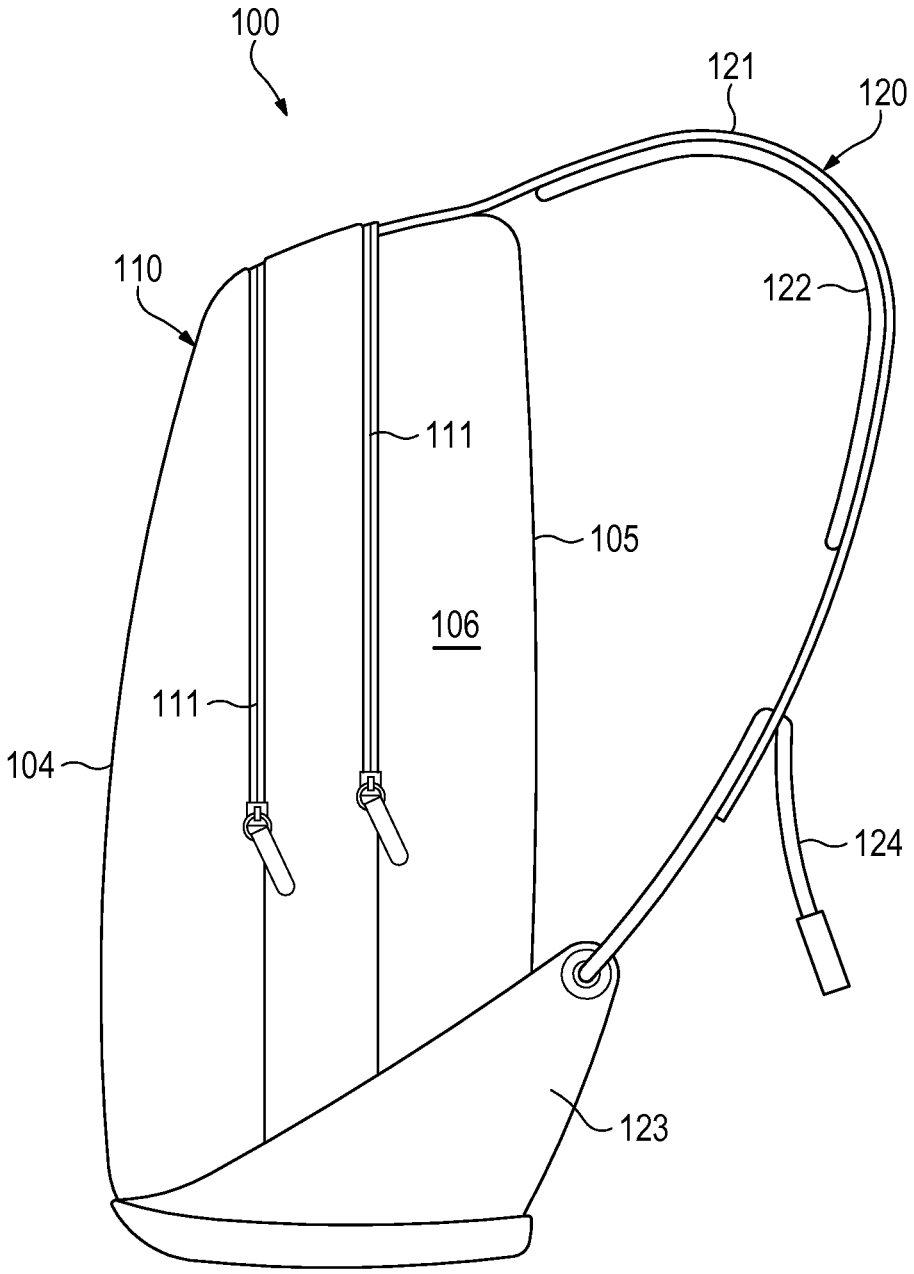
FIGS. 3 and 4 are side elevational views of the first carry bag.
Figure 4:
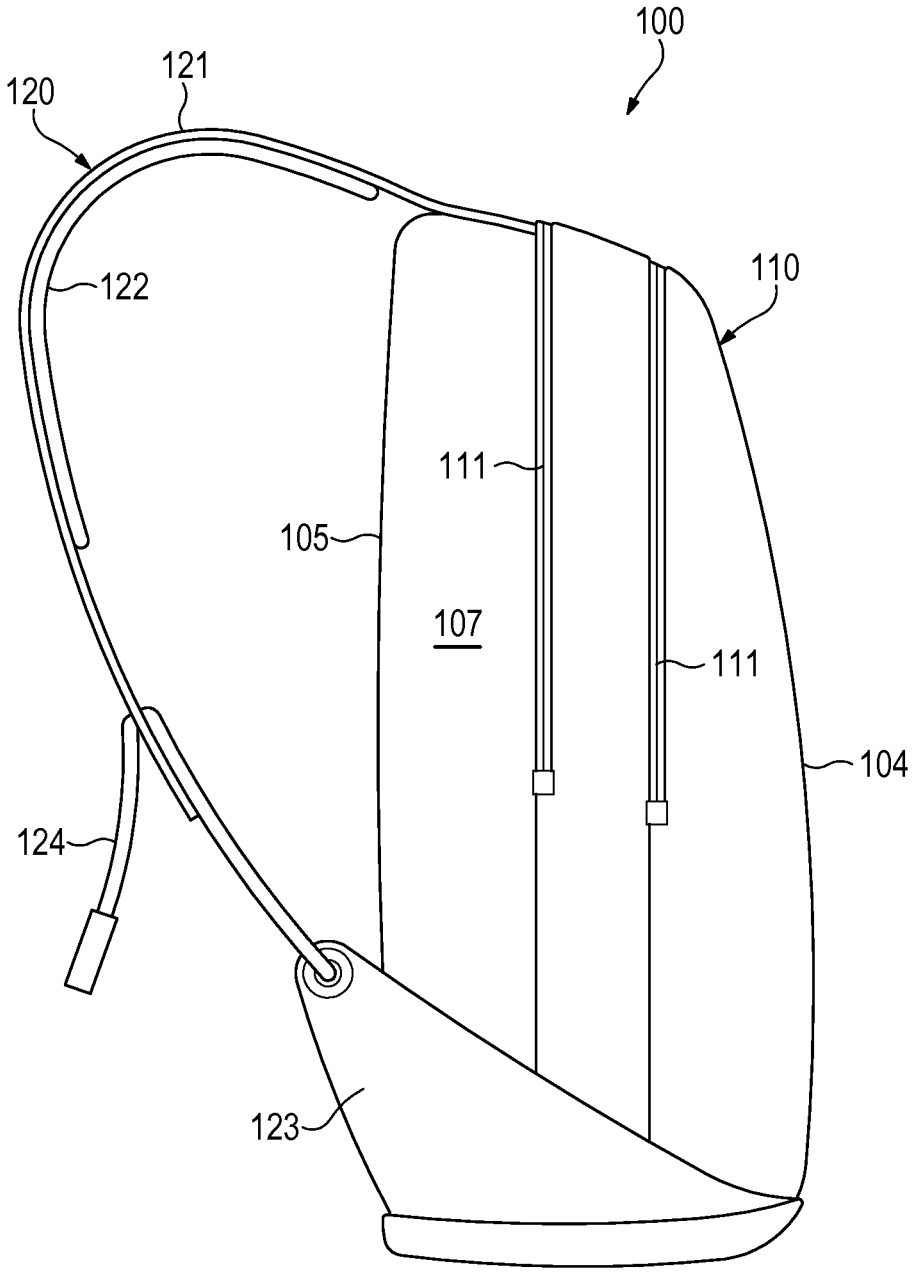
Figure 5:
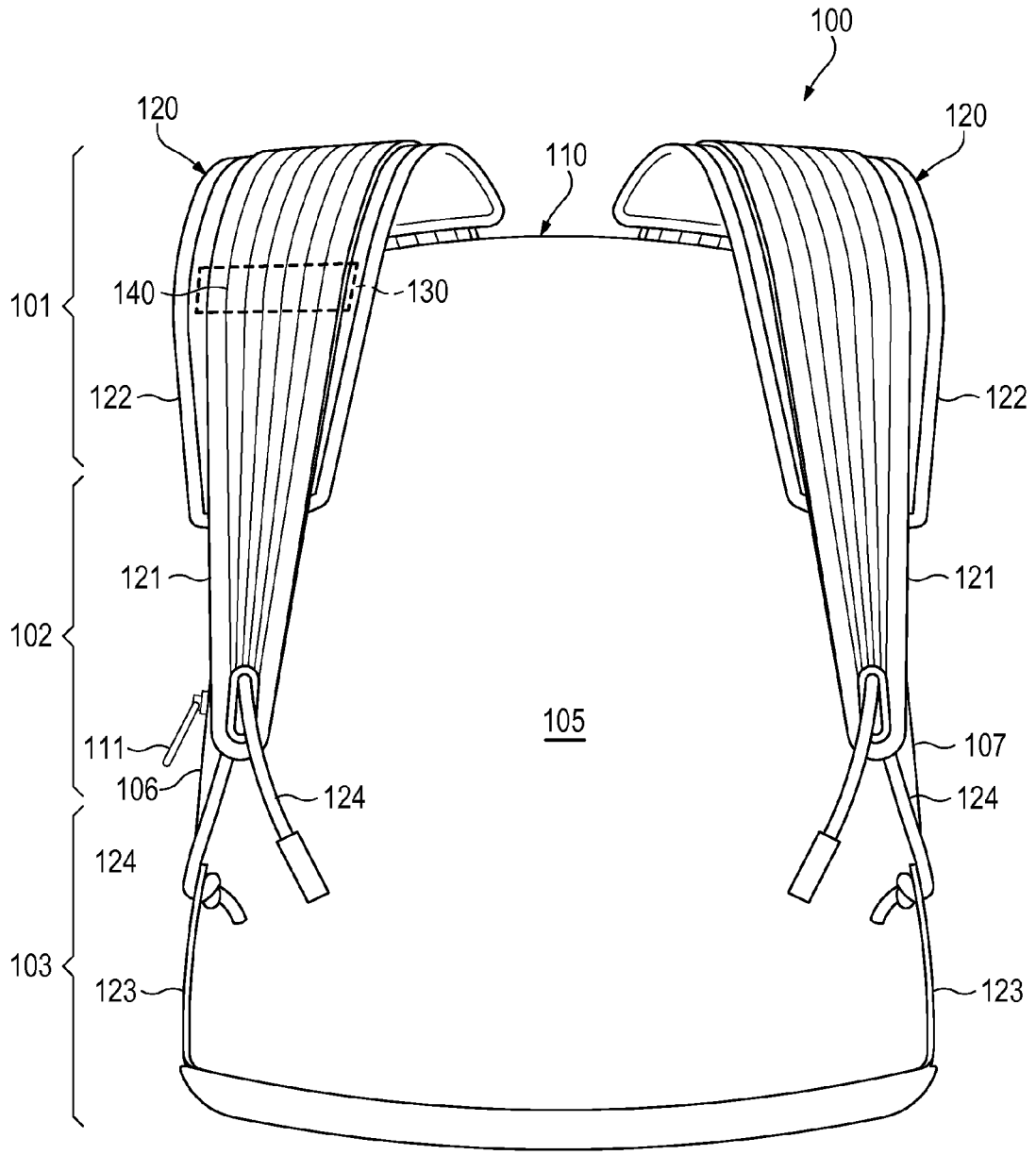
FIG. 5 is a rear elevational view of the first carry bag.

The following discussion and accompanying figures disclose a variety of carry bags that incorporate tensile strand reinforcing elements. Although the carry bags are disclosed as having the configurations of backpacks, handbags, duffel bags, and messenger bags, concepts discussed in relation to these configurations may be applied to a variety of other carry bag types.

Carry Bag Configurations

A carry bag 100 having the configuration of a backpack is disclosed in FIGS. 1-5 as including a container portion 110 and a pair of strap portions 120. In general, container portion 110 has a hollow structure that defines an interior compartment for receiving personal belongings or other items, and strap portions 120 are utilized to carry or otherwise transport carry bag 100. Although carry bag 100 may be carried in a variety of ways, a conventional manner involves placing strap portions 120 over the shoulders of an individual such that container portion 110 rests against the back of the individual. When worn in this manner, the weight of the items within container portion 110 induces tension in strap portions 120 and is borne by the shoulders of the individual.

For purposes of reference in the following discussion, carry bag 100 may be divided into three general regions: an upper region 101, a middle region 102, and a lower region 103. Carry bag 100 also includes a front area 104, a rear area 105, and a pair of opposite side areas 106 and 107. Regions 101-103 and areas 104-107 are not intended to demarcate precise areas of carry bag 100. Rather, regions 101-103 and areas 104-107 are intended to represent general areas of carry bag 100 to aid in the following discussion. In addition to carry bag 100, regions 101-103 and areas 104-107 may also be applied to container portion 110, strap portions 120, and individual elements thereof.

Container portion 110 may incorporate elements of various materials (e.g., natural or synthetic textiles, polymer sheets, leather, synthetic leather, polymer foam) that are joined to form a structure that defines the interior compartment. Depending upon the intended use for carry bag 100 and the items intended to be carried by carry bag 100 (e.g., within the interior compartment), the shape and size of container portion 110 may vary significantly. A pair of zippers 111 extend over upper region 101 and through portions of side areas 106 and 107. Zippers 111 open to provide access to the interior compartment, thereby permitting items to be located within carry bag 100 and removed from carry bag 100. Zippers 111 also close to effectively seal and secure the interior compartment. As alternatives to zippers 111, various closure devices that include buttons, snaps, flaps, magnetic elements, or hook-and-loop elements may be utilized to provide access to the interior compartment and close the interior compartment. Although the interior of carry bag 100 may be entirely hollow, various dividers, pockets, or other devices may be utilized to partition the interior compartment into separate sub-compartments. Moreover, each of zippers 111 may provide access to the separate sub-compartments. Padded elements may also be located within the interior compartment to protect items (e.g., a notebook computer). Although not depicted, various pockets or other compartments may be located on an exterior of container portion 110 to hold smaller items (e.g., keys, wallet, camera, mobile phone). Cinch straps may also be accessible from the exterior of container portion 110 to secure the contents of the interior compartment from shifting as carry bag 100 is worn. Various clips or other securing devices may also be present on the exterior (e.g., to hold a water bottle). Accordingly, the structure of container portion 100 may vary significantly to include a variety of features related to receiving, securing, and transporting items.

Strap portions 120 are joined to container portion 110 and extend outward from container portion 110 to form loops that extend around the arms or shoulders of the individual when carry bag 100 is worn. Although two strap portions 120 are depicted with carry bag 100, some configurations may include a single strap portion 120. Each of strap portions 120 includes an upper element 121, a cushioning element 122, a lower element 123, and an adjustment element 124. Upper elements 121 are secured to and extend outward from container portion 110 in upper region 101, and each of cushioning elements 122 are secured to one of upper elements 121 to enhance the comfort of wearing carry bag 100. When wearing carry bag 100, upper elements 121 extend over the shoulders of the individual such that cushioning elements 122 contact and rest upon the shoulders, thereby comfortably distributing the weight of carry bag 100 over the surfaces of the shoulders. In order to enhance comfort, cushioning elements 122 may incorporate polymer foam materials or fluid-filled chambers. Lower elements 123 are secured to and extend outward from container portion 110 in lower region 103, and adjustment elements 124 extend between ends of upper elements 121 and lower elements 123. When wearing carry bag 100, the individual may manipulate adjustment elements 124 in order to increase and decrease the overall length of strap portions 120, thereby securing carry bag 100 to the individual or permitting carry bag 100 to be removed from the individual. Depending upon the intended use for carry bag 100, the shapes and sizes of strap portions 120, as well as the elements incorporated into strap portions 120, may vary significantly.

Various materials (e.g., natural or synthetic textiles, polymer sheets, leather, synthetic leather) may be incorporated into strap portions 120. As discussed above, for example, cushioning elements 122 may incorporate polymer foam materials or fluid-filled chambers to enhance comfort. Various straps, grommets, and fasteners may also be utilized for adjustment element 124. In addition to these material elements, strap portions 120 may incorporate a material 130 that includes various strands 140. Referring to FIGS. 1-5, material 130 is incorporated into upper elements 121. In this configuration, strands 140 provide tensile reinforcing elements that resist longitudinal stretch in upper elements 121. As discussed in greater detail below, material 130 and strands 140 may be incorporated into various other elements of carry bag 100 (e.g., container portion 110, lower element 123) to provide tensile reinforcing elements that resist stretch. Material 130 and strands 140 may also reinforce areas of or elements within carry bag 100

Material Configuration

Figure 6:
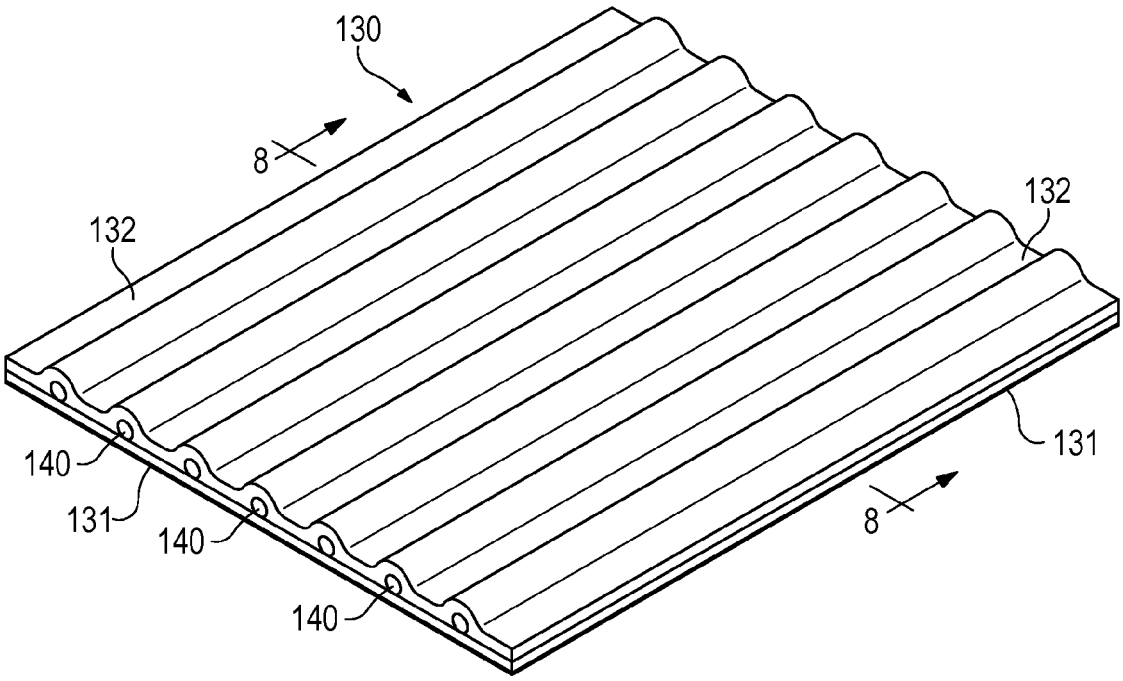
FIG. 6 is a perspective view of a material element from a strap portion of the first carry bag.
Figure 7:
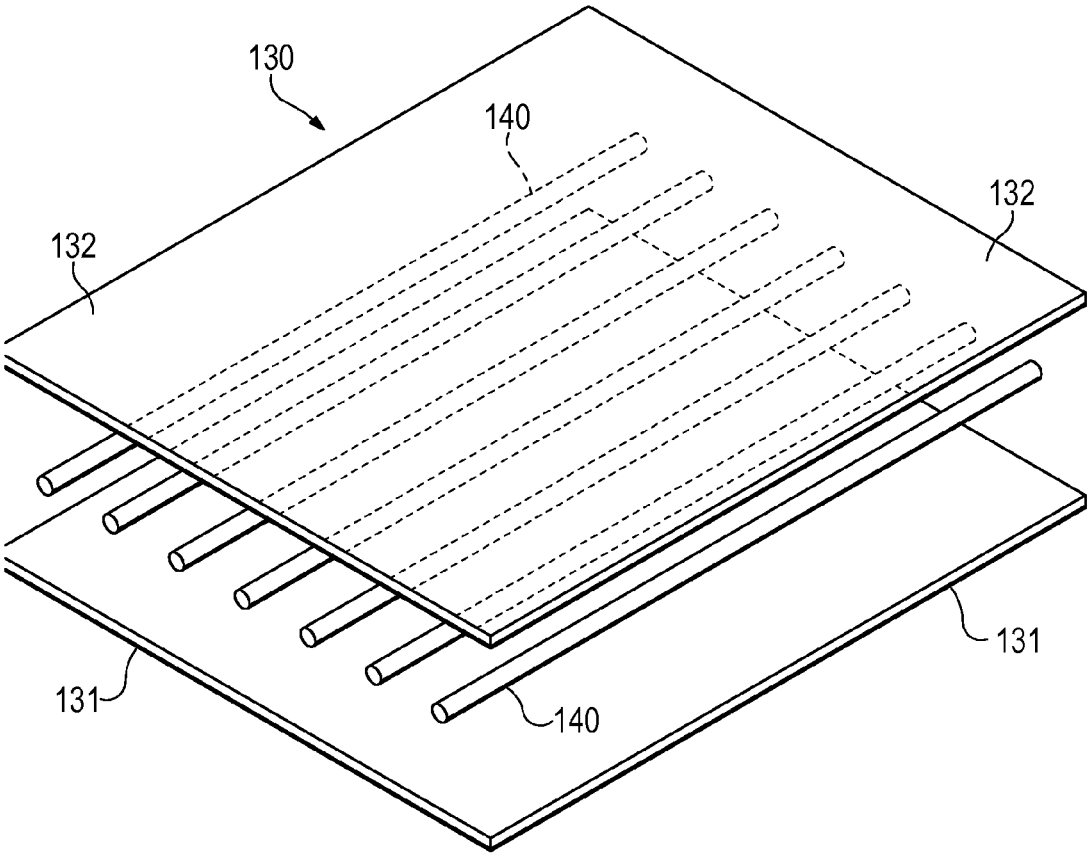
FIG. 7 is an exploded perspective view of the material element.
Figure 8:
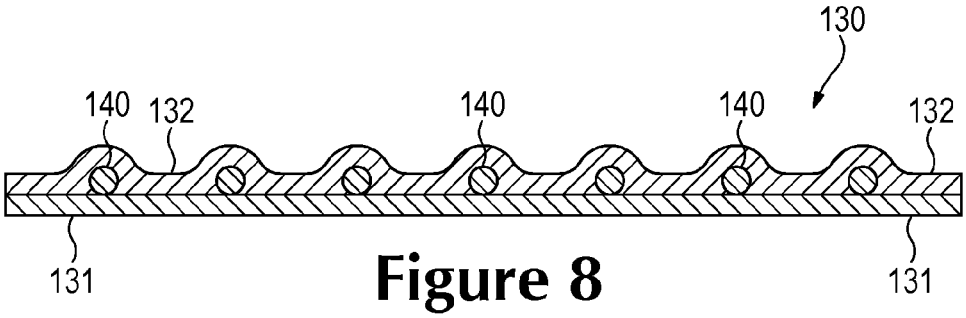
FIG. 8 is a cross-sectional view of the material element, as defined by section line 8-8 in FIG. 6.

An element of material 130, which may be a portion from either of upper elements 121, is depicted in FIGS. 6 and 7. Material 130 includes a base layer 131, a cover layer 132, and the various strands 140. In general, strands 140 are located between base layer 131 and cover layer 132, as depicted in FIG. 8, and a majority of strands 140 lie adjacent to and are substantially parallel to a surface of at least base layer 131. In order to secure the positions of strands 140, cover layer 132 may be bonded or otherwise joined to base layer 131, and may also be joined to strands 140. Whereas base layer 131 and cover layer 132 may stretch when subjected to a tensile force, strands 140 stretch to a lesser degree when subjected to the same tensile force. Strands 140 form, therefore, tensile reinforcing elements that resist stretch in material 130 and also resist stretch in upper elements 121. Whereas strands 140 resist stretch in the directions along which strands 140 lie, base layer 131 and cover layer 132 may stretch in directions that are perpendicular to strands 140.

Each of base layer 131 and cover layer 132 may be formed from any generally two-dimensional material. As utilized with respect to the present invention, the term "two-dimensional material" or variants thereof is intended to encompass generally flat materials exhibiting a length and a width that are substantially greater than a thickness. Accordingly, suitable materials for base layer 131 and cover layer 132 include various textiles, polymer sheets, or combinations of textiles and polymer sheets, for example. Textiles are generally manufactured from fibers, filaments, or yarns that are, for example, either (a) produced directly from webs of fibers by bonding, fusing, or interlocking to construct non-woven fabrics and felts or (b) formed through a mechanical manipulation of yarn to produce a knitted or woven fabric. The textiles may incorporate fibers that are arranged to impart one-directional stretch or multi-directional stretch, and the textiles may include coatings that form a breathable and water-resistant barrier, for example. The polymer sheets may be extruded, rolled, or otherwise formed from a polymer material to exhibit a generally flat aspect. Two-dimensional materials may also encompass laminated or otherwise layered materials that include two or more layers of textiles, polymer sheets, or combinations of textiles and polymer sheets. In addition to textiles and polymer sheets, other two-dimensional materials may be utilized for base layer 131 and cover layer 132. Although two-dimensional materials may have smooth or generally untextured surfaces, some two-dimensional materials will exhibit textures or other surface characteristics, such as embossing, dimpling, protrusions, ribs, or various patterns, for example. Despite the presence of surface characteristics, two-dimensional materials remain generally flat and exhibit a length and a width that are substantially greater than a thickness.

Strands 140 may be formed from any generally one-dimensional material. As utilized with respect to the present invention, the term "one-dimensional material" or variants thereof is intended to encompass generally elongate materials exhibiting a length that is substantially greater than a width and a thickness. Accordingly, suitable materials for strands 140 include various filaments, fibers, and yarns, that are formed from rayon, nylon, polyester, polyacrylic, silk, cotton, carbon, glass, aramids (e.g., para-aramid fibers and meta-aramid fibers), ultra high molecular weight polyethylene, and liquid crystal polymer. Yarns may be formed from at least one filament or a plurality of fibers. Whereas filaments have an indefinite length, fibers have a relatively short length and generally go through spinning or twisting processes to produce a yarn of suitable length. With regarding to yarns formed from filaments, these yarns may be formed from a single filament or a plurality of individual filaments grouped together. Yarns may also include separate filaments formed from different materials, or yarns may include filaments that are each formed from two or more different materials. Similar concepts also apply to yarns formed from fibers. Accordingly, filaments and yarns may have a variety of configurations exhibiting a length that is substantially greater than a width and a thickness. In addition to filaments and yarns, other one-dimensional materials may be utilized for strands 140. Although one-dimensional materials will often have a cross-section where width and thickness are substantially equal (e.g., a circular or square cross-section), some one-dimensional materials may have a width that is greater than a thickness (e.g., a rectangular, oval, or otherwise elongate cross-section). Despite the greater width, a material may be considered one-dimensional if a length of the material is substantially greater than a width and a thickness of the material.

Although base layer 131, cover layer 132, and strands 140 may be formed from any of the variety of materials discussed above, an example of suitable materials is as follows: Base layer 131 may be a textile that exhibits stretch greater than ten percent prior to tensile failure. Cover layer 132 may be a thermoplastic polymer sheet (e.g., thermoplastic polyurethane) that bonds with base layer 131 and strands 140 to secure strands 140 within material 130. In addition, strands 140 may be threads formed from a plurality of substantially non-stretch filaments. When formed of these materials, material 130 will generally stretch in directions that are perpendicular to strands 140 and in areas where strands 140 are absent, but strands 140 will generally restrict stretch in directions that are parallel or along the length of strands 140. Furthermore, the transparent or at least semi-transparent properties of cover layer 132 permits strands 140 to be visible through cover layer 132, which imparts an aesthetic aspect to carry bag 100.

Strands 140 generally lie adjacent to a surface of base layer 131. Portions of strands 140 may, however, extend through base layer 131. For example, an embroidery process may be utilized to locate and secure strands 140 on base layer 131, and the embroidery process may cause portions of strands 140 to extend through base layer 131. In areas where strands 140 extend through base layer 131, strands 140 are directly joined or otherwise secured to base layer 131. In areas where strands 140 lie adjacent to base layer 131, strands 140 may be unsecured to base layer 131 or may be joined to base layer 131 with cover layer 132 or another securing element that bonds, secures, or otherwise joins portions of strands 140 to base layer 131.

Conventional backpack straps may include threads, for example, that join textile elements together or provide ornamentation. Unlike these threads, which form stitches that extend through the textile elements every few millimeters, portions of strands 140 generally lie adjacent to a surface of base layer 131 for distances of at least five centimeters. In some configurations of carry bag 100 and in some location on carry bag 100, strands 140 may lie adjacent to a surface of base layer 131 for distances greater than ten centimeters, thirty centimeters, or even fifty centimeters. Whereas the stitched threads are utilized to join textile elements, strands 140 lie adjacent to a surface of base layer 131 to form tensile reinforcing members. Some textile elements in conventional backpack straps may also be formed from threads that extend along a length of the backpack straps. That is, threads that actually form the textile elements in conventional backpack straps may extend along a length of the backpack straps. Unlike these threads, strands 140 are separate from base layer 131 and merely lie adjacent to base layer 131. As noted above, base layer 131 may be a textile that exhibits stretch greater than ten percent prior to tensile failure. Strands 140, however, are separate from base layer 131 and exhibit less stretch in order to provide tensile reinforcing members that restrict the stretch in base layer 131.

Carry bag 100 has the general configuration of a backpack. When items are located within container portion 110 and carry bag 100 is being worn by an individual, the weight of container portion 110 and the items within container portion 110 may induce tensile forces in strap portions 120 that tend to stretch material 130 in upper elements 121. The various strands 130 are located to form tensile reinforcing members in upper elements 121. That is, strands 140 form structural elements that resist stretch in strap portions 120. Given that strands 140 extend along a longitudinal axis of upper elements 121, strands 140 collectively resist stretch in at least the longitudinal direction.

Conventional backpack straps incorporate materials that resist stretch from tensile forces. As an example, a woven textile may be incorporated into a backpack strap to impart stretch resistance along a longitudinal axis of the strap (i.e., in the longitudinal direction). A woven textile is formed from yarns that interweave at substantially right angles to each other. If the woven textile is incorporated into the conventional backpack strap for purposes of longitudinal stretch-resistance, then only the yarns oriented in the longitudinal direction will contribute to longitudinal stretch-resistance, and the yarns oriented orthogonal to the longitudinal direction will not generally contribute to longitudinal stretch-resistance. Approximately one-half of the yarns in the woven textile are, therefore, superfluous to longitudinal stretch-resistance. As a further example, the degree of stretch-resistance required in different areas of a conventional backpack strap may vary. Whereas some areas of the conventional backpack strap may require a relatively high degree of stretch-resistance, other areas of the conventional backpack strap may require a relatively low degree of stretch-resistance. Because the woven textile may be utilized in areas requiring both high and low degrees of stretch-resistance, some of the yarns in the woven textile are superfluous in areas requiring the low degree of stretch-resistance. In each of these examples, the superfluous yarns add to the overall mass and cost of the conventional backpack strap, without adding beneficial properties to the conventional backpack. Similar concepts apply to other materials, including knit textiles.

In contrast with materials incorporated into conventional backpack straps, material 130 is constructed to minimize the presence of superfluous material. Base layer 131 provides a substrate to which strands 140 are secured by cover layer 132, and layers 131 and 132 generally have a relatively minimal mass. Strands 140 are located to provide stretch-resistance in particular, desired directions, and the number of strands 140 is selected to impart only the desired degree of stretch-resistance and the desired strength. Accordingly, the orientations, locations, and quantity of strands 140 may be selected to provide tensile reinforcing elements that are tailored to a specific purpose.

Further Material Configurations

Figure 9A:
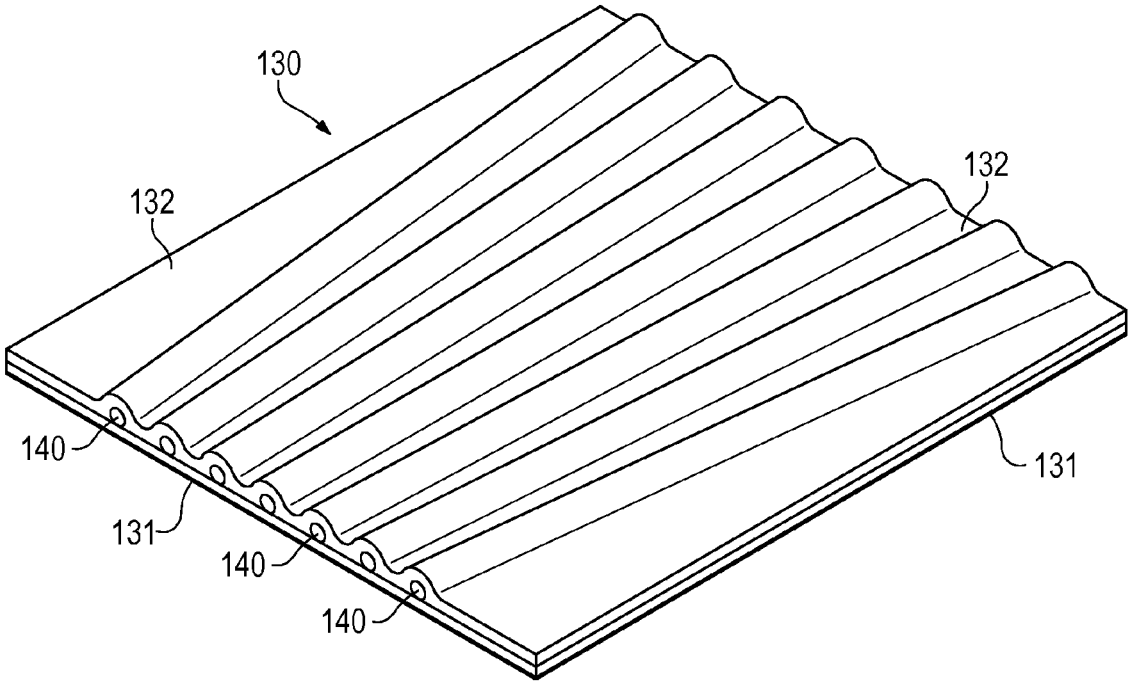
FIGS. 9A-9G are perspective views corresponding with FIG. 6 and depicting further configurations of the material element.
Figure 9B:
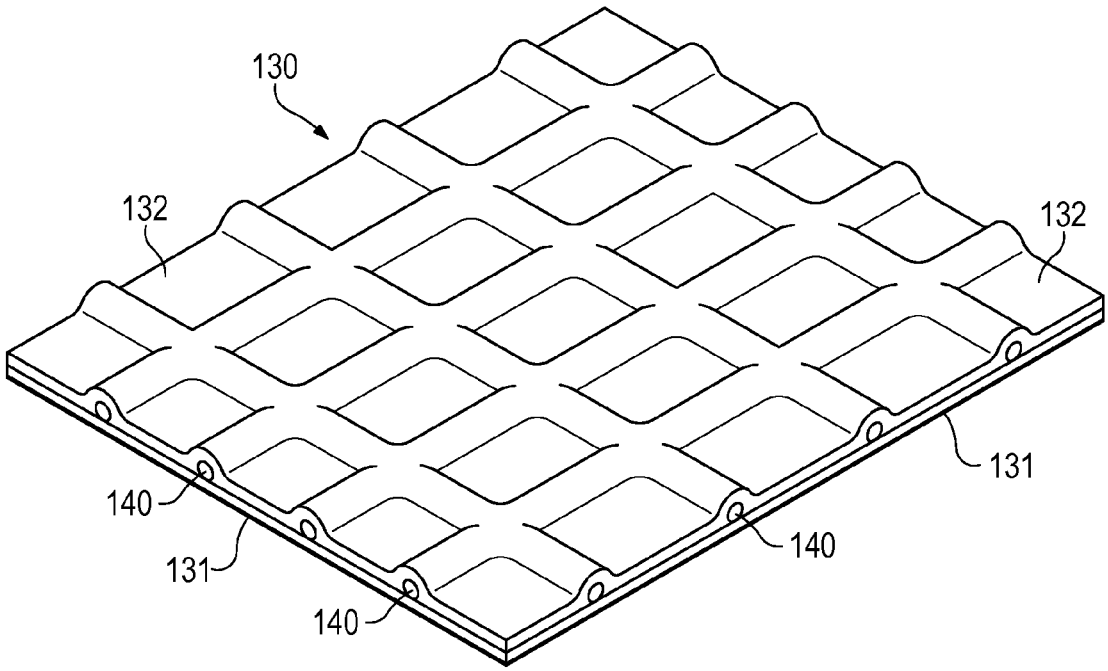
Figure 9C:
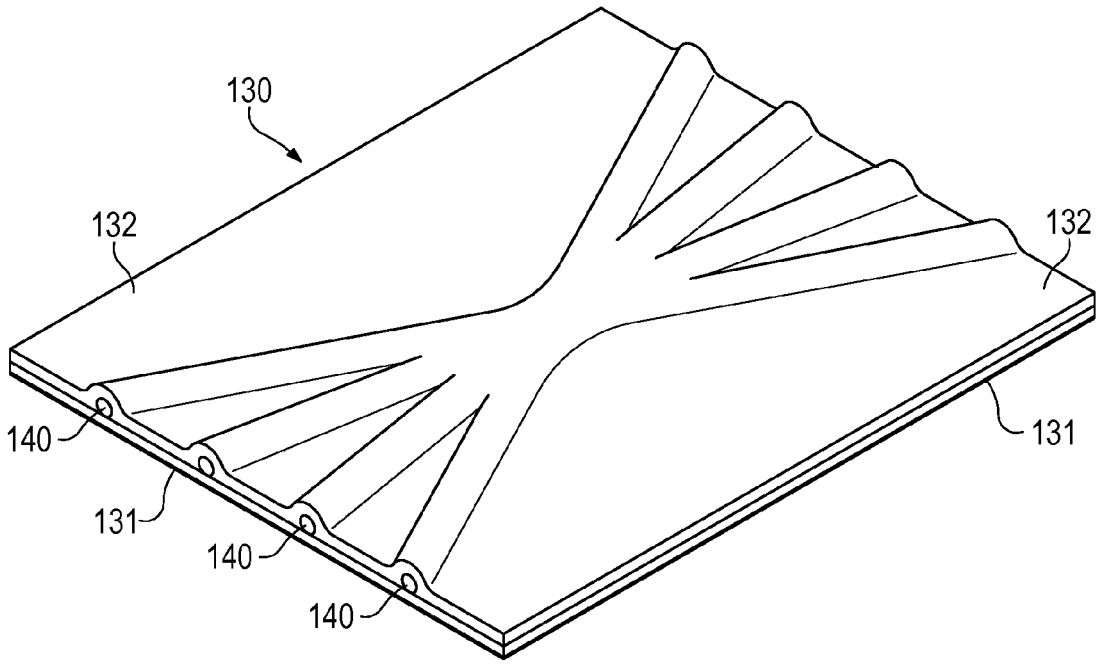

The configuration of material 130 depicted in FIGS. 6-8 provides an example of a suitable configuration for use in carry bag 100. A variety of other configurations may also be utilized carry bag 100. Referring to FIG. 9A, strands 140 are depicted as radiating outward or otherwise having a generally non-parallel configuration. The stretch-resistance of a particular area of material 130 at least partially depends upon the concentration of strands 140 in that particular area. By changing the spacing between strands 140 in different areas of material 130, the stretch resistance in the different areas may be altered. Referring to FIGS. 9B and 9C, strands 140 are depicted as crossing each other. When strands 140 are substantially parallel to each other, strands 140 resist stretch in the directions along which strands 140 lie, but base layer 131 and cover layer 132 may stretch in directions that are perpendicular to strands 140. When strands 140 cross each other or have generally non-parallel configurations, then strands 140 may impart stretch-resistance to various directions.

Figure 9D:
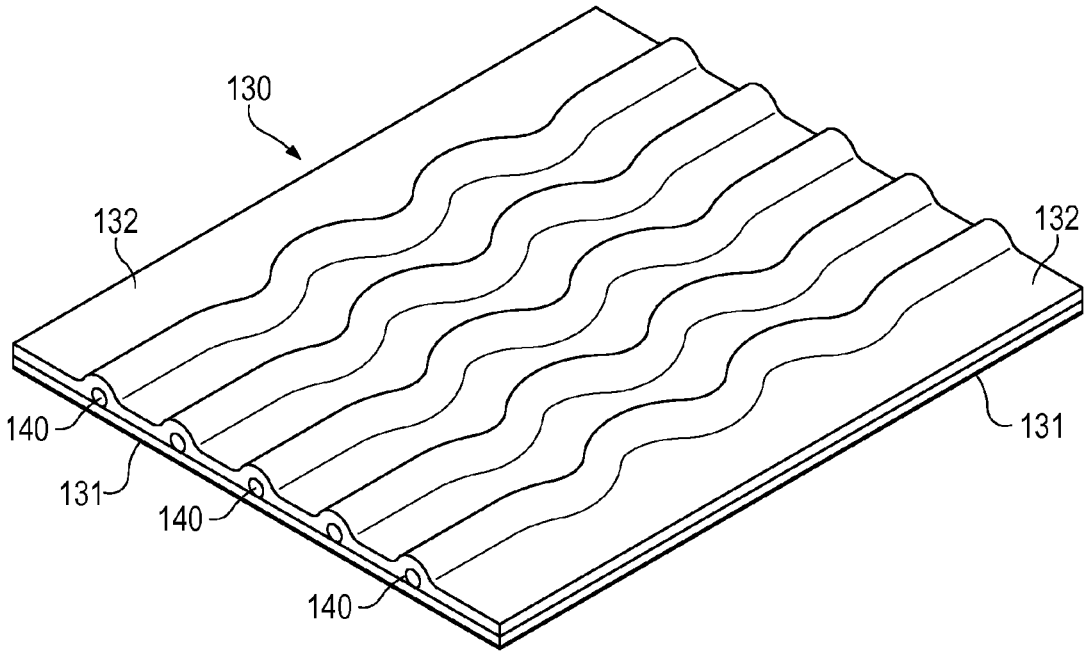
Figure 9E:
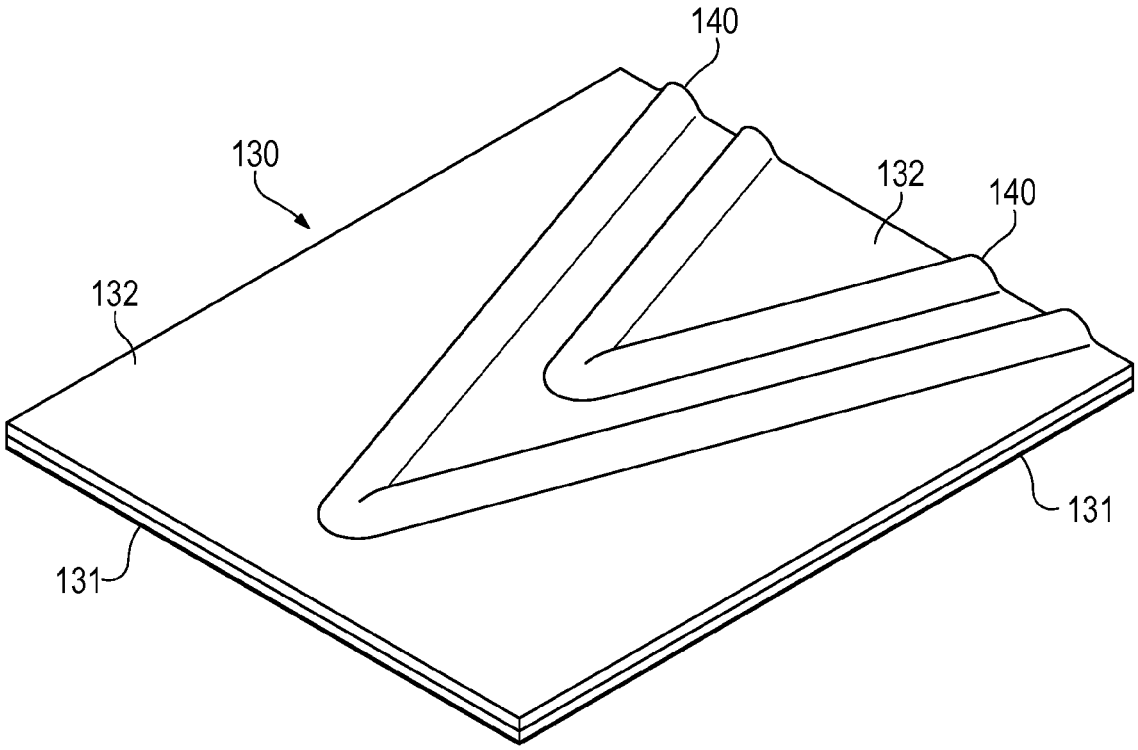

In each of configurations for material 130 discussed above, strands 140 are arranged in generally straight lines relative to layers 131 and 132. Referring to FIG. 9D, however, portions of strands 140 have wave-like or non-straight portions. In general, strands 140 resist stretch in the directions along which strands 140 lie. When formed to have wave-like or non-straight portions, strands 140 may permit some stretch in layers 131 and 132, until at least these portions are straightened. Referring to FIG. 9E, strands 140 exhibit an angled structure. When an embroidery process is utilized to lay strands upon base layer 131, portions of strands 140 may extend through base layer 131 at the point of the angle in order to secure strands 140 to base layer 131.

Figure 9F:
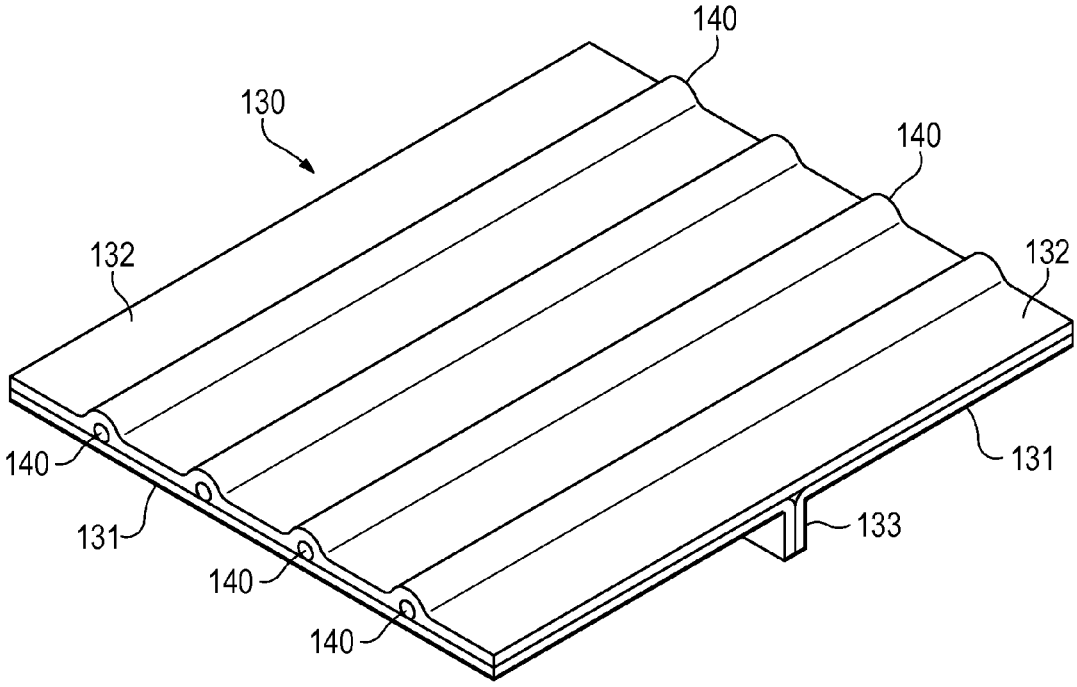

Base layer 131 may have a unitary (i.e., one piece) configuration. In some configurations of carry bag 100, however, base layer 131 may be formed from multiple, joined elements. Referring to FIG. 9F, base layer 131 is depicted as being formed from two elements that are joined by a seam 133, and strands 140 extend across seam 133. When two textile elements joined by a seam are placed in tension, the seam generally experiences stresses associated with the tension. Strands 140, however, extend across seam 133 and may reduce the stresses within seam 133 when material element is placed under tension. Examples of areas where strands 140 may cross a seam include locations where strap portions (e.g., strap portions 120) are joined to a container portion (e.g., container portion 110) and also where strands cross seams joining two or more material elements that form either a container portion or a strap portion.

Figure 9G:
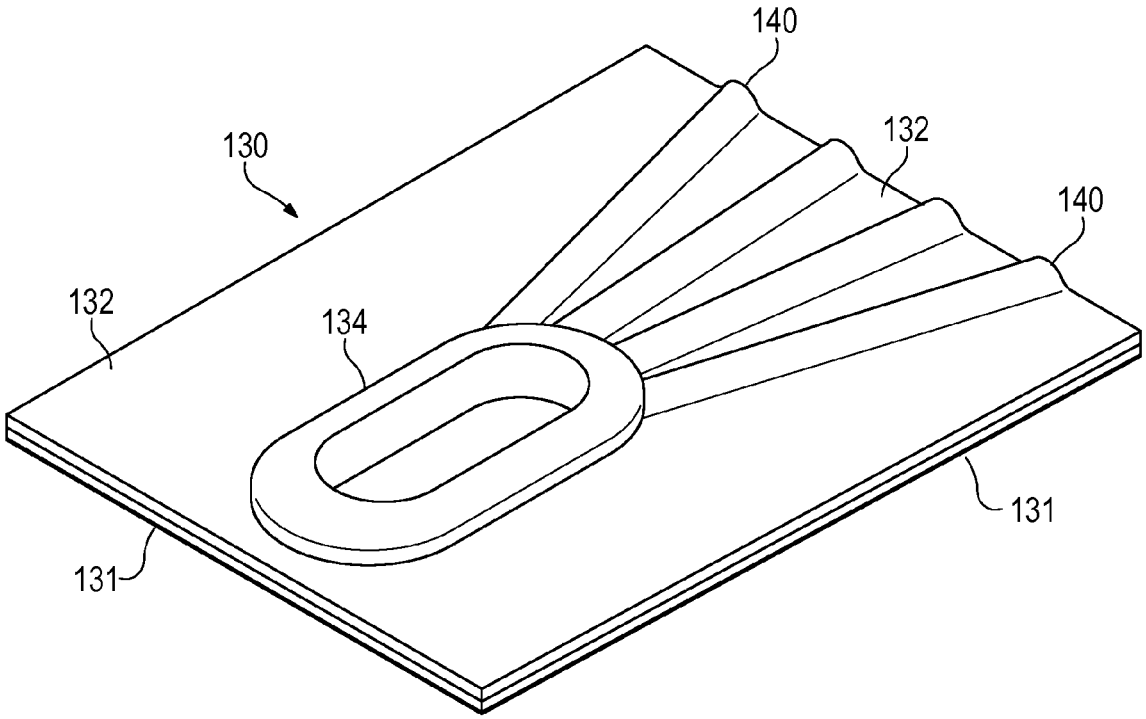

Referring to FIG. 9G, a grommet 134 forms an aperture in material 130, and strands 140 extend outward from grommet 134. Grommet 134 may be utilized, for example, to receive a portion of adjustment element 124, thereby joining upper element 121 with adjustment element 124. By locating strands 140 immediately adjacent to grommet 134, tensile forces may be transferred directly to strands 140. Additionally, locating strands 140 immediately adjacent to grommet 134 serves to reinforce the area around grommet 134. Strands 140 may be utilized to reinforce areas around other elements in carry bag 100, including zippers 111, the region where strap portions 120 are joined to container portion 110, and seams or areas where elements of carry bag 100 are joined to each other.

Figure 10A:
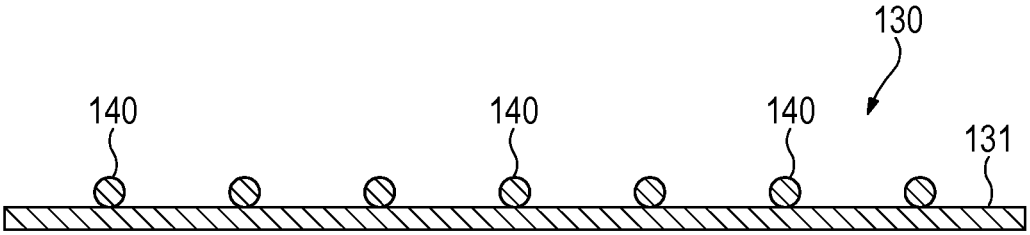
FIGS. 10A-10F are cross-sectional views corresponding with FIG. 8 and depicting further configurations of the material element.
Figure 10B:
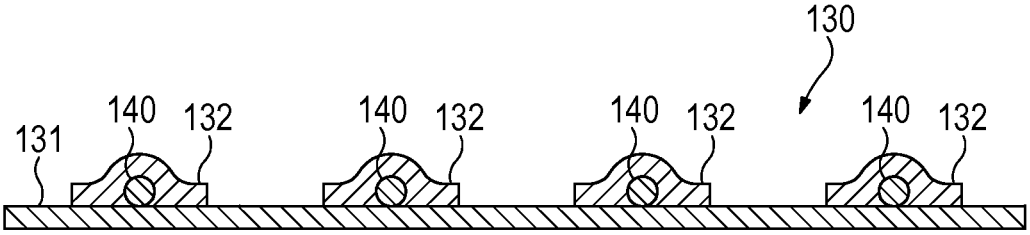
Figure 10C:
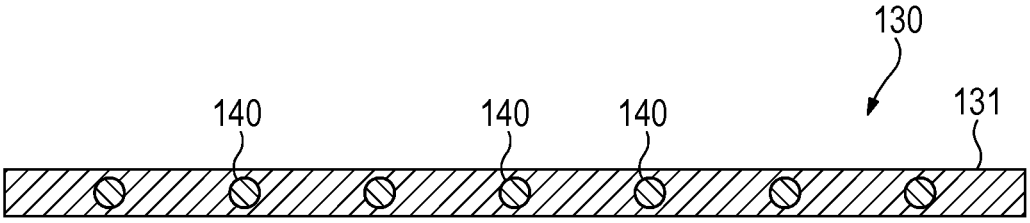

The configuration of layers 131 and 132 may also vary significantly within material 130. Referring to FIG. 10A, material 130 is depicted as having a configuration wherein cover layer 132 is absent. In this configuration, strands 140 may, for example, be unsecured to the surface of base layer 131, or only end points of strands 140 may be secured to the surface of base layer 131. Alternately, an adhesive may be utilized to join strands 140 to base layer 131. As a further alternative, either or both of base layer 131 and strands 140 may include a thermoplastic material that bonds strands 140 to base layer 131 when cover layer 132 is absent. In another configuration, depicted in FIG. 10B, cover layer 132 may be absent in areas between strands 140, thereby exposing a surface of base layer 131. Referring to FIG. 10C, cover layer 132 is absent and strands 140 are depicted as being embedded within base layer 131. When base layer 131 is formed from a sheet of polymer material (e.g., a thermoplastic polymer material), base layer 131 may be heated such that strands 140 extend below the surface of base layer 131.

Figure 10D:
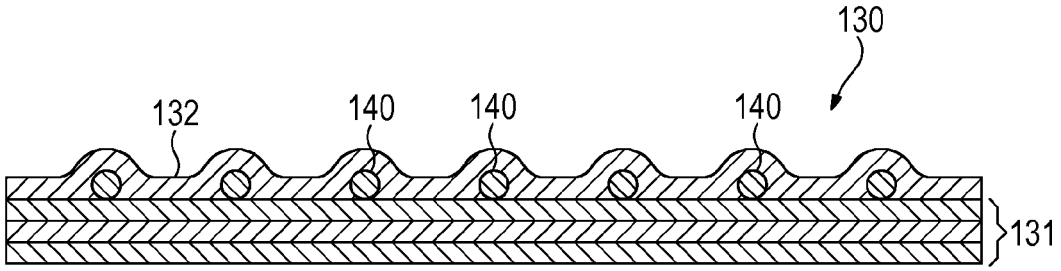
Figure 10E:
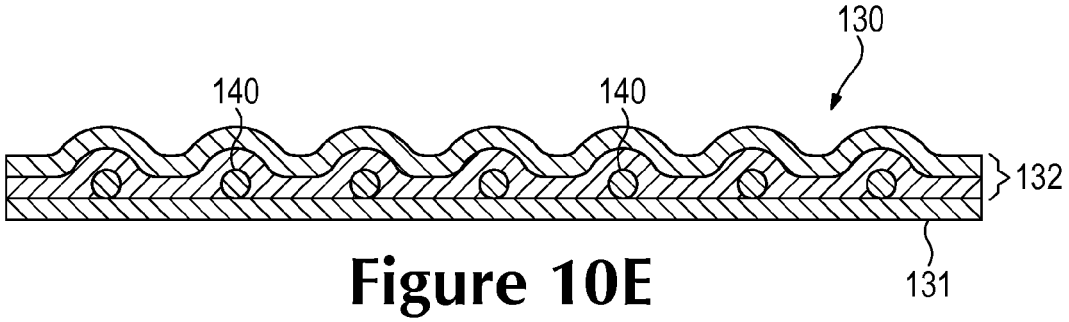
Figure 10F:
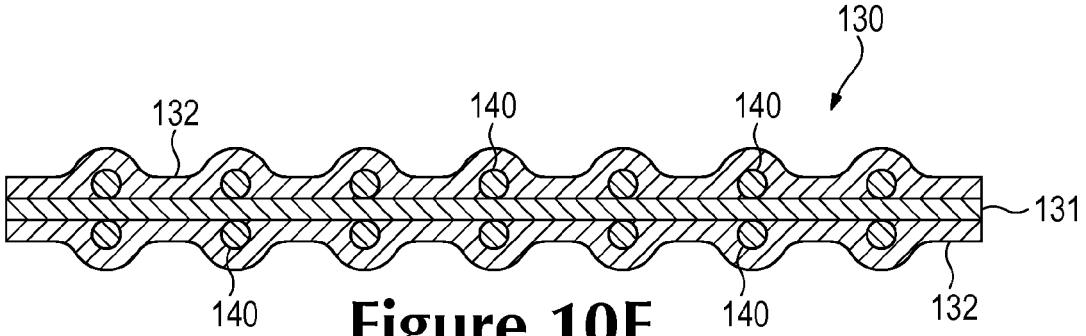

In other configurations of material 130, either of layers 131 and 132 may be formed from multiple, different layers. Referring to FIG. 10D, base layer 131 includes three different layers, which may be any of the various two-dimensional materials discussed above. As an example, base layer 131 may include textile, polymer sheet, and polymer foam layers that each contribute different properties to material 130. A similar configuration, wherein cover layer 132 is formed from two layers, is depicted in FIG. 10E. In a further configuration, depicted in FIG. 131, various strands 140 and two cover layers 132 are located on opposite sides of base layer 131. Accordingly, material 130 may have a variety of configurations.

Manufacturing Methods

A variety of manufacturing methods may be utilized to produce material 130. As an example, an embroidery machine may be utilized to lay strands 140 on a surface of base layer 131. Once strands 140 are positioned, cover layer 132 may be bonded to base layer 131 such that strands 140 are positioned between layers 131 and 132. In some configurations, base layer 131 may be formed as a textile that is impregnated with a thermoplastic polymer material. Once strands 140 are positioned on base layer 131, heat may be applied to bond strands 140 to base layer 131 with the thermoplastic polymer material, or heat may be utilized to bond cover layer 132 to base layer 131 with the thermoplastic polymer material. As yet another example, an embroidery process disclosed in U.S. Patent Application Publication Number 2007/0271821, entitled Article Of Footwear Having An Upper With Thread Structural Elements and entirely incorporated herein by reference, may be utilized.

As an alternative to embroidery, base layer 131 may be placed within a frame having various pins around which strands 140 are wrapped. As strands 140 extend between pins on opposite sides of the frame, strands 140 extend over defined areas of base layer 131. In this manner, strands 140 may be located relative to the surface of base layer 131. In another method, an adhesive or thermoplastic tape with one or more strands 140 embedded therein may be secured to base layer 131.

Further Carry Bag Configurations

Figure 11:
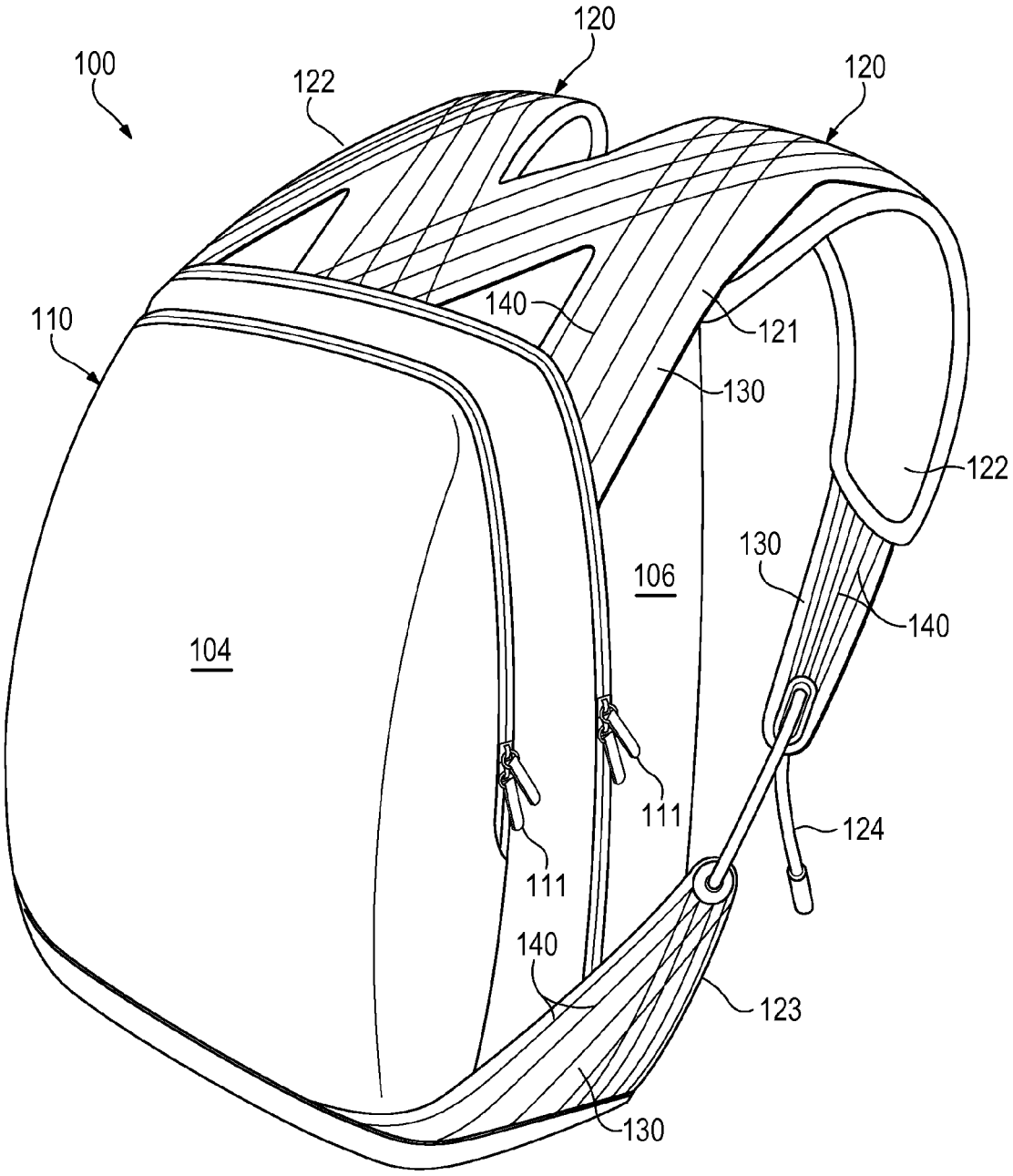
FIGS. 11-13 are perspective views of further configurations of the first carry bag.

Another configuration of carry bag 100 is depicted in FIG. 11. In this configuration, each of upper elements 121 branch to join with container portion 110 in two locations. Strands 140 located within upper elements 121 also cross each other (as in FIGS. 9B and 9C) to extend along each of the branches in upper elements 121. Furthermore, at least a portion of material 130 is located in lower element 123 to form tensile reinforcing elements in another area of each strap portion 120.

Figure 12:
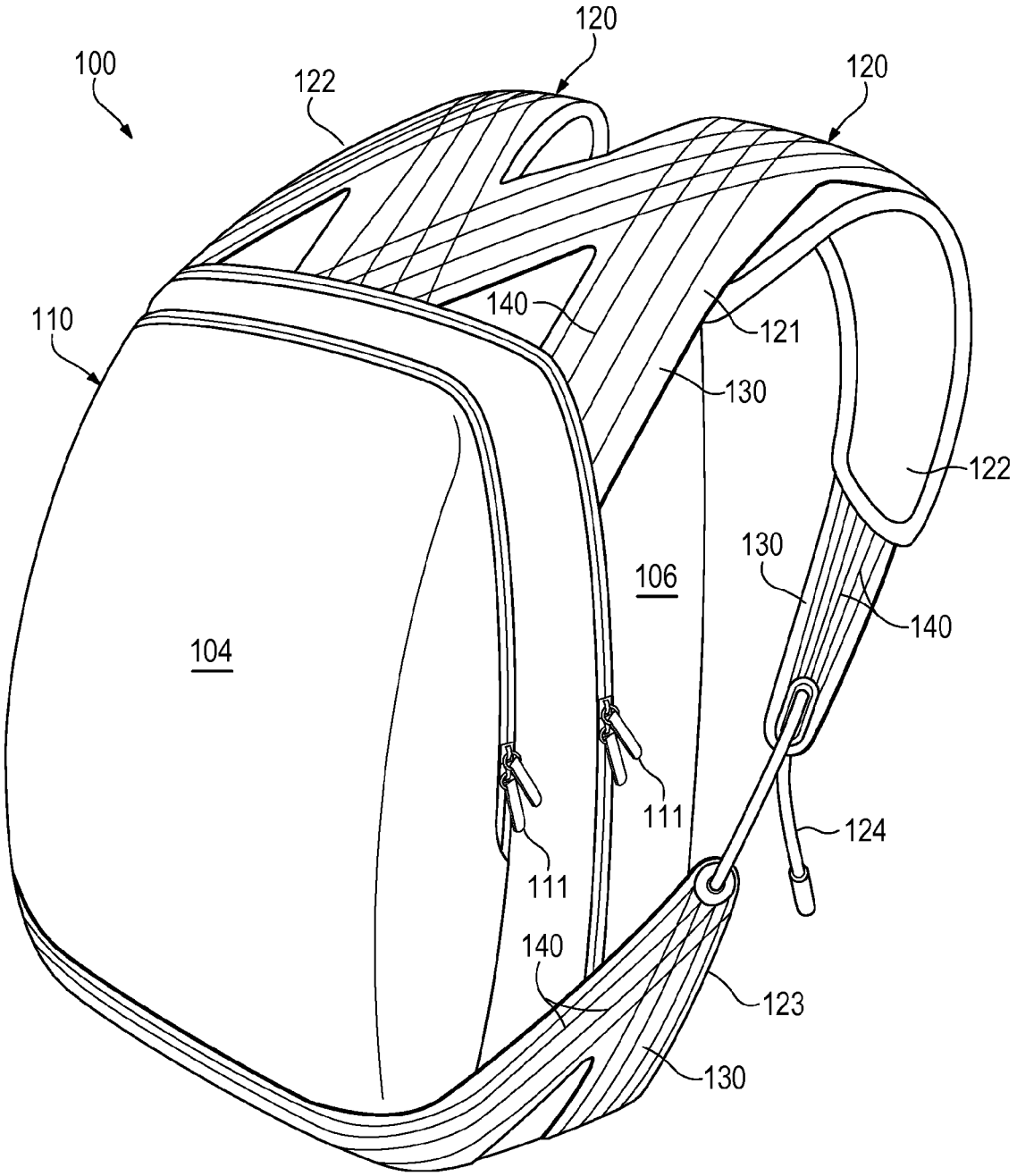
Figure 13:
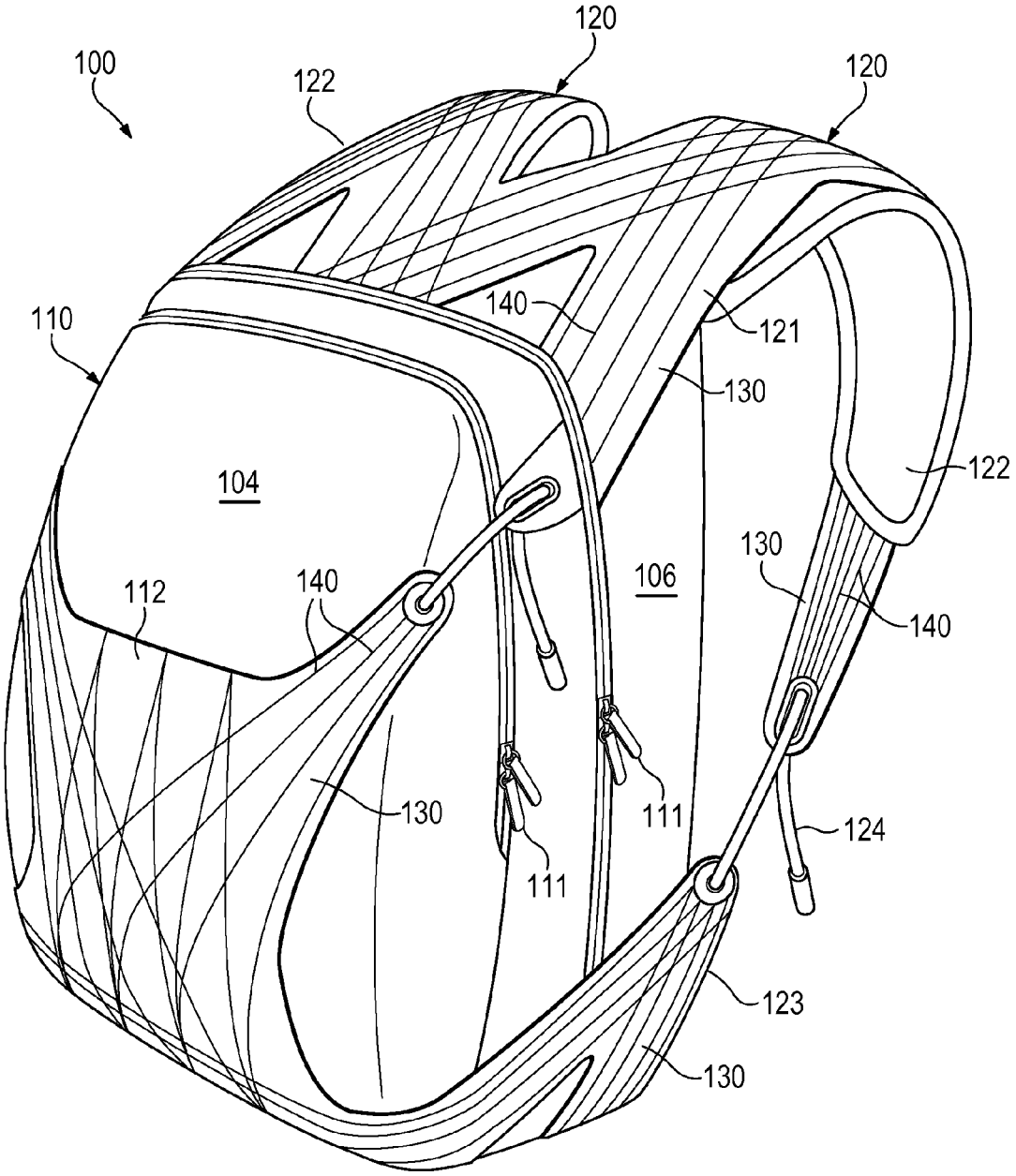

Referring to FIG. 12, material 130 extends around lower region 103 of container portion 110. When relatively heavy items (e.g., books, notebook computer) are located within container portion 110, the items may induce stresses in container portion 110, particularly in lower region 103. By incorporating material 130 into this area, strands 140 may form tensile reinforcing elements that resist stretch or otherwise bear stresses associated with the items in container portion 110. Carry bag 100 may also include an flap 112, as depicted in FIG. 13, that covers a portion of an exterior of container portion 110. By incorporating material 130 into flap 112, strands 140 may form tensile reinforcing elements that resist stretch or otherwise bear stresses associated with the items in container portion 110.

Figure 14:
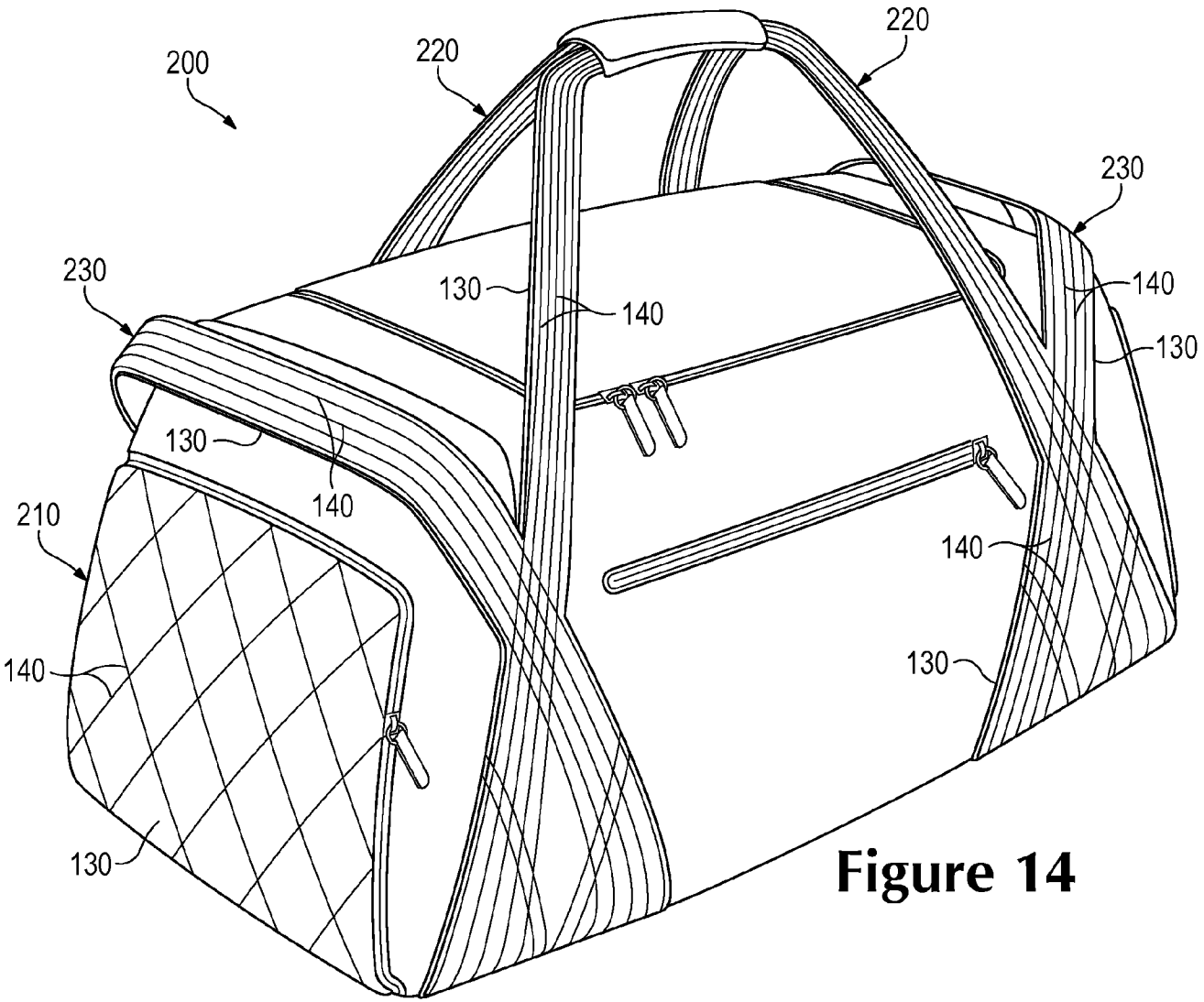
FIG. 14 is a perspective view of a second carry bag having a design of a duffel bag.

A carry bag 200 having the configuration of a duffel bag is disclosed in FIG. 14 as including a container portion 210 and a pair of strap portions 220. In general, container portion 210 has a hollow structure that defines an interior compartment for receiving personal belongings or other items, and strap portions 220 are utilized to carry or otherwise transport carry bag 200. Ends of container portion 210 also include a pair of supplemental strap portions 230 that may also be used to transport carry bag 200. As with carry bag 100, carry bag 200 incorporates material 130 in various locations. For example, material 130 extends (a) around areas of container portion 210, (b) along sides of container portion 210, (c) through each of strap portions 220 and 230, and (d) from strap portions 220 and 230 to container portion 210. That is, strands 140 extend through various areas of carry bag 200 to form tensile reinforcing elements that resist stretch or otherwise bear stresses in container portion 210 and strap portions 220 and 230.

As noted above, carry bag 200 incorporates material 130 in various locations. The configuration of material 130 may vary significantly, depending upon the specific location of material 130 in carry bag 200. That is, material 130 may have any of the various configurations depicted in FIGS. 6-10F. In strap portions 220 and 230, for example, strands 140 may be substantially parallel to each other (as in FIGS. 6 and 7) and extend in a direction that is substantially parallel to longitudinal axes of strap portions 220 and 230. Various strands may also cross each other (as in FIGS. 9B and 9C) in the sides and ends of container portion 210. Although material 130 may be formed from strands 140 and each of layers 131 and 132, cover layer 132 may be absent in some areas. Similarly, either of layers 131 and 132 may also be formed from two or more different layers of material in some configurations.

In carry bag 200, strands 140 extend continuously from strap portions 220 to container portion 210 and around a lower area of container portion 210. That is, unbroken or otherwise uncut strands 140 extend through multiple areas of carry bag 200. Although base layer 131 may also have a continuous configuration, base layer 131 may also be formed from multiple, joined elements such that continuous portions of strands 140 extend across seams between the elements. As with the configuration of material 130 shown in FIG. 9F, therefore, strands 140 may cross seams when extending through the various areas of carry bag 200. An advantage of this configuration is that strands 140 may reduce the stresses within the seams.

Figure 15:
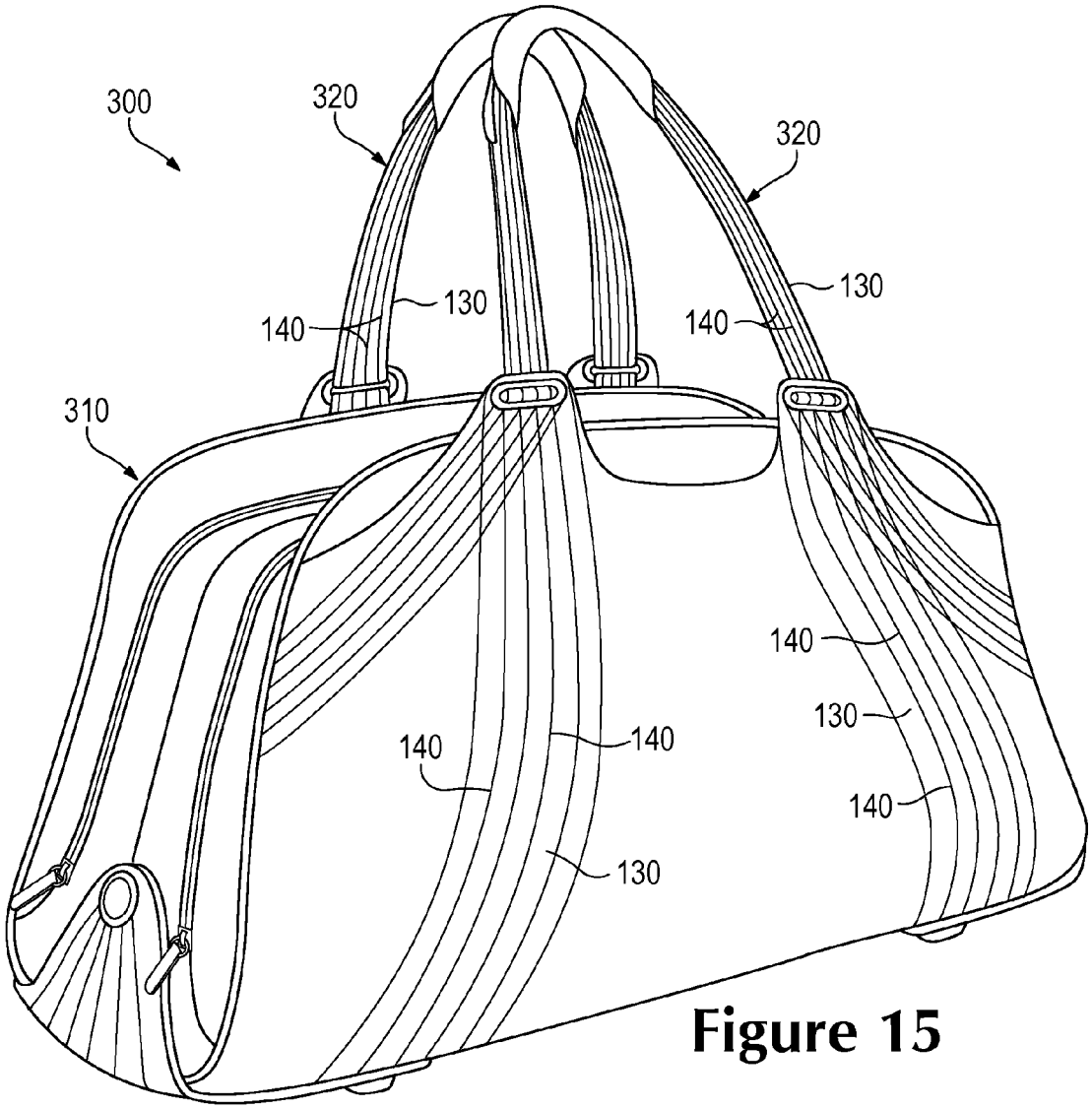
FIG. 15 is a perspective view of a third carry bag having a design of a handbag.

A carry bag 300 having the configuration of a hand bag is disclosed in FIG. 15 as including a container portion 310 and a pair of strap portions 320. In general, container portion 310 has a hollow structure that defines an interior compartment for receiving personal belongings or other items, and strap portions 320 are utilized to carry or otherwise transport carry bag 300. As with carry bag 100, carry bag 300 incorporates material 130 in various locations. For example, material 130 extends (a) around areas of container portion 310, (b) along sides of container portion 310, and (c) through each of strap portions 320. That is, strands 140 extend through various areas of carry bag 300 to form tensile reinforcing elements that resist stretch or otherwise bear stresses in container portion 310 and strap portions 320.

Figure 16:
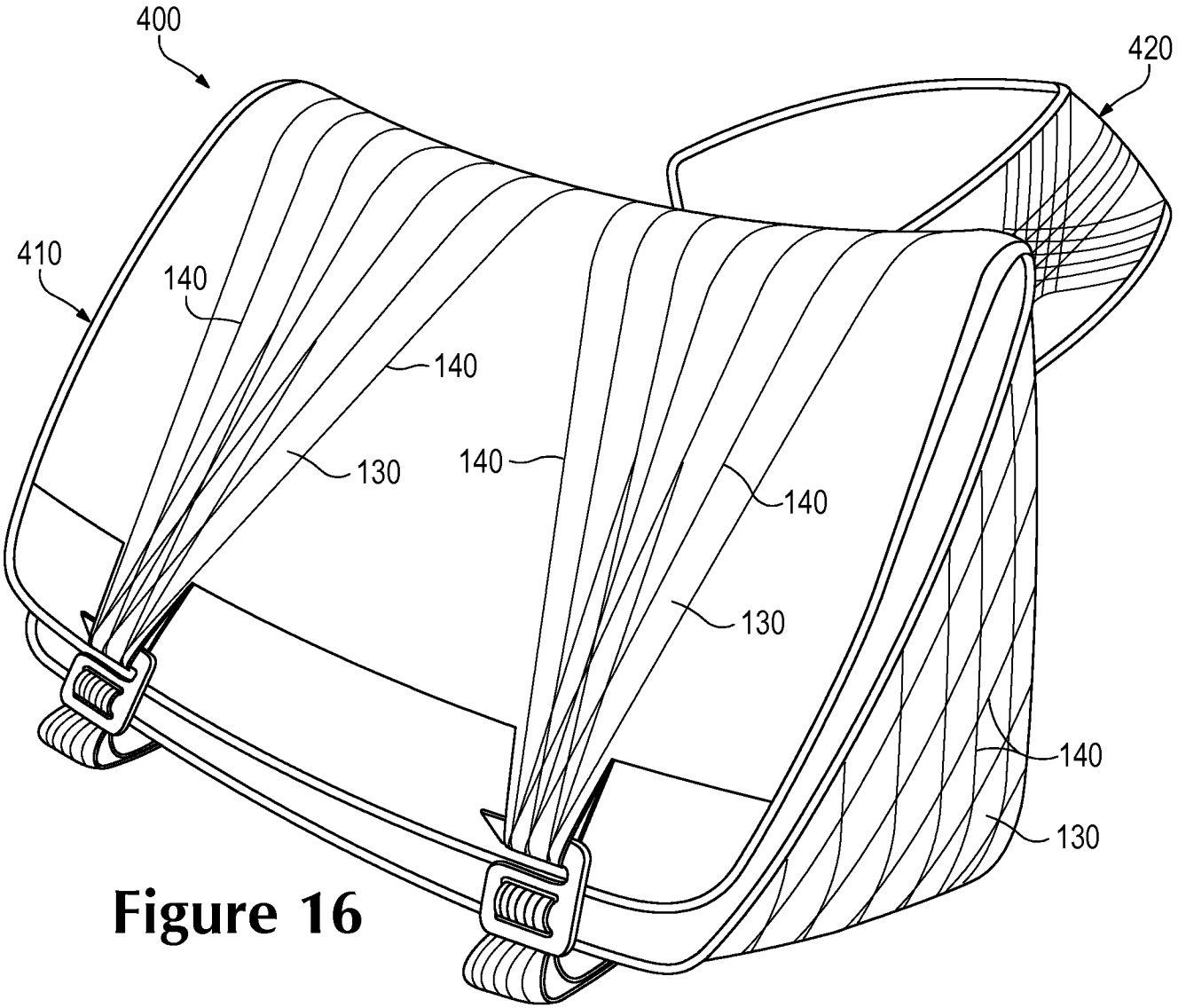
FIGS. 16 and 17 are perspective views of a fourth carry bag having a design of a messenger bag.
Figure 17:
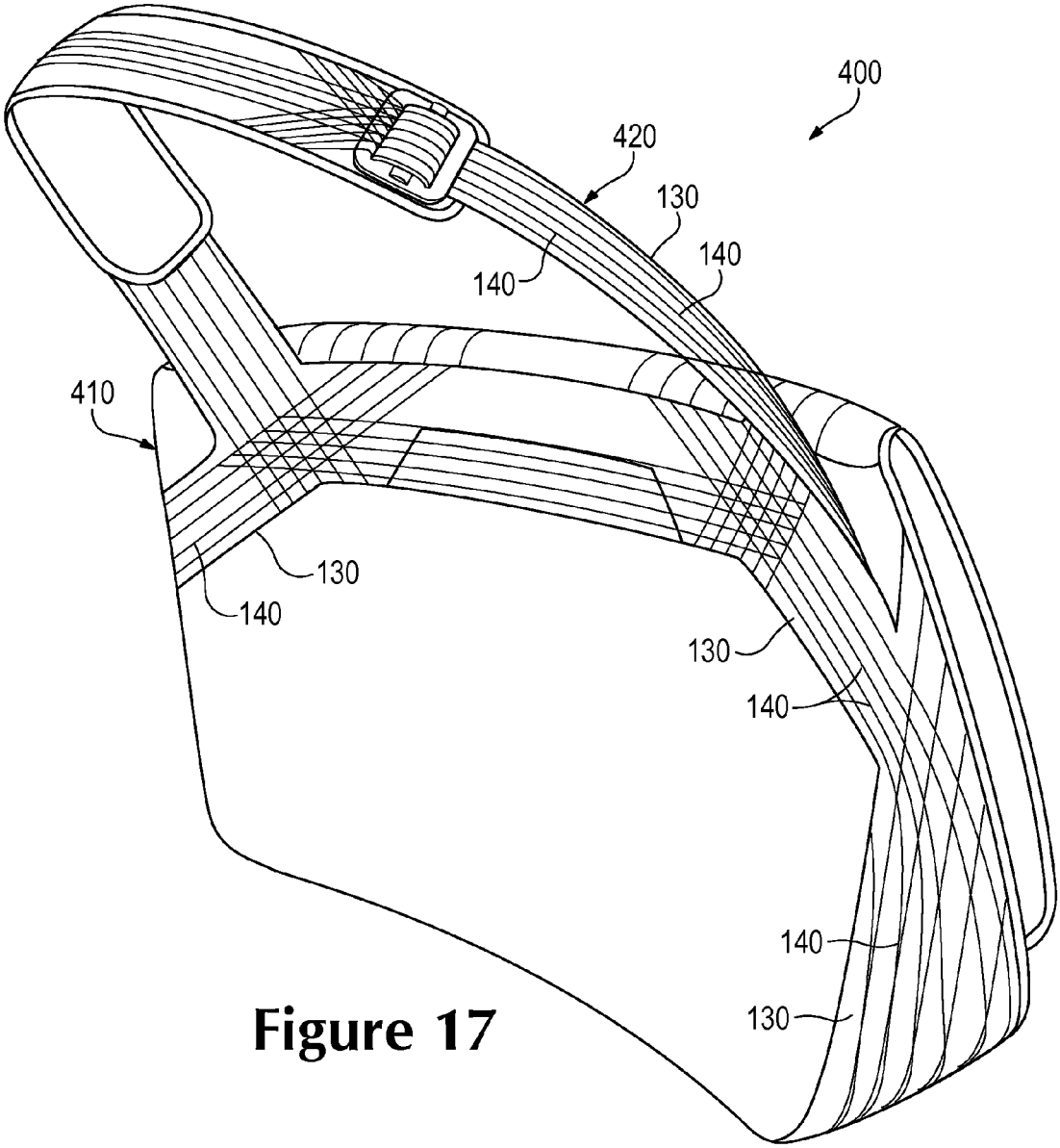

Another carry bag 400 having the configuration of a messenger bag is disclosed in FIGS. 16 and 17 as including a container portion 410 and a strap portion 420. In general, container portion 410 has a hollow structure that defines an interior compartment for receiving personal belongings or other items, and strap portion 420 is utilized to carry or otherwise transport carry bag 400. As with carry bag 100, carry bag 400 incorporates material 130 in various locations. For example, material 130 extends (a) around areas of container portion 410, (b) along sides of container portion 410, (c) through a flap of container portion 410, and (d) through each of strap portions 420. That is, strands 140 extend through various areas of carry bag 400 to form tensile reinforcing elements that resist stretch or otherwise bear stresses in container portion 410 and strap portions 420.

Conclusion

Various carry bag configurations are disclosed above and in the accompanying figures. In general, each of the carry bags include a container portion defining an interior compartment for containing objects, as well as a strap portion extending from the container portion. Moreover, at least one of the container portion and the strap portion include a base element 131 formed from a two-dimensional material and various strands 140 formed from a one-dimensional material. Strands 140 lie adjacent to and substantially parallel to a surface of base element 131 for a distance of at least five centimeters. In some configurations cover layer 132 may be joined with base element 131 to secure strands 140. In addition to imparting a particular aesthetic to the carry bags, strands 140 form tensile reinforcing elements that resist stretch or otherwise bear stresses in the carry bags.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. A carry bag comprising:

a container portion defining an interior compartment for containing objects, the container portion including a first element formed from a two-dimensional material that is impregnated with a thermoplastic polymer material;

a strap portion extending from the container portion, the strap portion including a second element formed from a two-dimensional material;

a first plurality of strands formed from a one-dimensional material extending from the container portion onto the strap portion, the first plurality of strands laying adjacent to and substantially parallel to both a surface of the first element of the container portion for a distance of at least five centimeters and a surface of the second element of the strap portion for a distance of at least five centimeters, wherein the thermoplastic polymer material of the first element of the container portion bonds the first plurality of strands to the first element of the container portion; and a second plurality of strands extend adjacent to the surface of the first element of the container portion without extending onto the strap portion, the second plurality of strands crossing the first plurality of strands.

2. The carry bag recited in claim 1, wherein the first element is joined to the second element at a seam, and the first plurality of strands extend across the seam.

3. The carry bag recited in claim 1, wherein at least one cover layer is bonded to each of the surface of the first element, the first plurality of strands, and the surface of the second element, and wherein the first plurality of strands is located between the cover layer and the each of the first element and the second element.

4. The carry bag recited in claim 3, wherein the cover layer is at least semi-transparent, and the first plurality of strands is at least partially visible through the cover layer.

5. The carry bag recited in claim 1, wherein the strap portion has an elongate configuration that defines a longitudinal axis, and the first plurality of strands extend in a direction that is substantially parallel to the longitudinal axis.

6. The carry bag recited in claim 1, wherein the strap portion is secured to an upper area of the container portion, and the first plurality of strands extend from the strap portion to a lower area of the container portion.

7. The carry bag recited in claim 1, wherein a material of the first plurality of strands is selected from a group consisting of carbon fiber, aramid fiber, ultra high molecular weight polyethylene, and liquid crystal polymer.

8. A carry bag comprising:

a container portion defining an interior compartment for containing objects; and a strap portion secured to and extending outward from the container portion, the strap portion including:

a base element formed from a two-dimensional material, the base element having a first surface and an opposite second surface, a grommet forming an aperture in the base element;

a plurality of strands formed from a one-dimensional material, the strands each having a first terminal end and a second terminal end both disposed adjacent to the base element and the strands extending from the first terminal end, laying adjacent to and substantially parallel to the first surface of the base element for a distance of at least five centimeters, to the second terminal end, wherein the plurality of strands extend outwardly from the grommet such that the each of the plurality of strands diverge from one another as each of the plurality of strands extends outwardly from the grommet;

at least one cover layer bonded to the first surface of the base element and to at least one strand of the plurality of strands, the entirety of each of the plurality of the strands being located between the cover layer and the first surface; and a cushioning element positioned adjacent to the second surface of the base element.

9. The carry bag recited in claim 8, wherein the base element is attached to the cover layer continuously along a space disposed between a first strand of the plurality of strands and a second strand of the plurality of strands.

10. The carry bag recited in claim 9, wherein the strands are visible through the cover layer.

11. The carry bag recited in claim 8, wherein the strap portion has an elongate configuration that defines a longitudinal axis, and the strands extend in a direction that is substantially parallel to the longitudinal axis.

12. The carry bag recited in claim 8, wherein the strands extend from the strap portion to the container portion, the strands laying adjacent to and substantially parallel to a surface of a material element incorporated into the container portion for a distance of at least five centimeters and the strands not extending through the material element incorporated into the container portion.

13. The carry bag recited in claim 12, wherein the strap portion is secured to an upper area of the container portion.

14. The carry bag recited in claim 8, wherein a material of the strands is selected from a group consisting of carbon fiber, aramid fiber, ultra high molecular weight polyethylene, and liquid crystal polymer.

15. A carry bag comprising:

a container portion defining an interior compartment for containing objects, the container portion including:

at least one base element formed from a two-dimensional material and extending around the interior compartment, and a first plurality of strands formed from a one-dimensional material, the first plurality of strands laying adjacent to and substantially parallel to a surface of the base element for a distance of at least five centimeters, and the first plurality of strands extending continuously from an upper area of the container portion to a lower area of the container portion, a second plurality of strands extending adjacent to the surface of the base element of the container portion, the second plurality of strands crossing the first plurality of strands only on the container portion; and a strap portion for carrying the carry bag, the strap portion being secured to and extending outward from the upper area of the container portion, wherein the first plurality of strands further extend from the container portion onto the strap portion and the first plurality of strands is not woven through the strap portion for a distance of at least five centimeters and are not crossed by strands other than the second plurality of strands.

16. The carry bag recited in claim 15, wherein at least one cover layer is secured to the surface of the base element, and the entirety of each strand of the first plurality of strands is located between the cover layer and the base element.

17. The carry bag recited in claim 16, wherein the cover layer is at least semi-transparent, the first plurality of strands being at least partially visible through the cover layer.

18. The carry bag recited in claim 15, wherein the strap portion has an elongate configuration that defines a longitudinal axis, and the first plurality of strands extend in a direction that is substantially parallel to the longitudinal axis.

19. The carry bag recited in claim 18, wherein the first plurality of strands extends onto the strap portion for a distance of at least five centimeters.

20. The carry bag recited in claim 15, wherein a material of the strands is selected from a group consisting of carbon fiber, aramid fiber, ultra high molecular weight polyethylene, and liquid crystal polymer.

21. A carry bag comprising a container portion and a strap portion, the container portion defining an interior compartment for containing objects, and the strap portion extending outwardly from the container portion, the strap portion including:

a base element formed from a two-dimensional material;

a grommet forming an aperture in the base element;

a plurality of strands formed from a one-dimensional material, the plurality of strands each having a first terminal end disposed at a first point on the base element and a second terminal end disposed at a second point on the base element at least five centimeters from the first point, wherein the plurality of strands extend adjacent to and substantially parallel to a surface of the base element from the first terminal end to the second terminal end, wherein the plurality of strands extend outwardly from the grommet such that the each of the plurality of strands diverge from one another as each of the plurality of strands extends outwardly from the grommet; and a cover layer secured to the surface of the base element, the cover layer being formed from a material that is at least semi-transparent, wherein the entirety of at least one strand of the plurality of the strands is located between the cover layer and the base element, and the plurality of the strands are at least partially visible through the cover layer.

22. The carry bag recited in claim 21, wherein the strands are located in the strap portion, the strap portion having an elongate configuration that defines a longitudinal axis, and the strand extending in a direction that is substantially parallel to the longitudinal axis.

23. The carry bag recited in claim 21, wherein the strands are located in the container portion and extend continuously from an upper area to a lower area of the container portion.

24. The carry bag recited in claim 23, wherein the strands extend from the strap portion to the container portion.

25. The carry bag recited in claim 23, wherein the strap portion is secured to an upper area of the container portion, and the strands extend from the strap portion to a lower area of the container portion.

26. A carry bag having a configuration of a backpack, the carry bag comprising:

a container portion defining an interior compartment for containing objects, the container portion having an upper area and an opposite lower area, at least the upper area including a zipper for providing access to the interior compartment;

a first strap portion secured to each of the upper area of the container portion and the lower area of the container portion, the first strap portion having a first base element impregnated with a thermoplastic polymer material and a first plurality of strands extending from the strap portion onto the container portion and each having a first terminal end and a second terminal end both disposed adjacent the first base element in the lower area of the container portion, the first plurality of strands extending from the first terminal end, laying adjacent to and substantially parallel to a surface of the first base element for a distance of at least five centimeters without being woven through the first strap portion for the distance of at least five centimeters, to the second terminal end, and the first strap portion having an elongate configuration that defines a longitudinal axis, at least a portion of the first plurality of strands extending in a direction that is substantially parallel to the longitudinal axis, wherein the thermoplastic polymer material of the first base element bonds the first plurality of strands to the first base element; and a second strap portion secured to each of the upper area of the container portion and the lower area of the container portion; and a second plurality of strand extend adjacent to the surface of the first element of the container portion without extending onto the strap portion, the second plurality of strands crossing the first plurality of strands.

27. The carry bag recited in claim 26, wherein at least one cover layer is secured to the surface of the first base element, and the first plurality of strands is located between the cover layer and the first base element.

28. The carry bag recited in claim 27, wherein the first plurality of strands is at least partially visible through the cover layer.

29. The carry bag recited in claim 26, wherein the first base element is attached to the cover layer adjacent to both a first side and a second side of at least one strand of the first plurality of strands.

30. The carry bag recited in claim 26, wherein the second strap portion has a second base element and a third plurality of strands each having a first terminal end and a second terminal end both disposed adjacent the second base element in the lower area of the container portion, the third plurality of strands each extending from the first terminal end of the third plurality of strands, laying adjacent to and substantially parallel to a surface of the second base element, to the second terminal end of the third plurality of strands, and the second strap portion having an elongate configuration that defines a longitudinal axis, at least a portion of the third plurality of strands extending in a direction that is substantially parallel to the longitudinal axis.

* * * * *